US005448931A

United States Patent [19]

Fossella et al.

[11] Patent Number: 5,448,931

[45] Date of Patent: * Sep. 12, 1995

[54] ADJUSTABLE WRENCH

[75] Inventors: Gregory Fossella, Osterville; Peter L. Lindenmuth, Boston, both of Mass.

[73] Assignee: Great Bay Tool Corp., Hyannis, Mass.

[ * ] Notice: The portion of the term of this patent subsequent to Apr. 26, 2011 has been disclaimed.

[21] Appl. No.: 221,384

[22] Filed: Mar. 31, 1994

Related U.S. Application Data

[63] Continuation of Ser. No. 871,845, Apr. 21, 1992, Pat. No. 5,305,670, which is a continuation-in-part of Ser. No. 638,828, Jan. 8, 1991, abandoned, which is a continuation-in-part of Ser. No. 387,220, Jul. 28, 1989, abandoned, Ser. No. 392,206, Aug. 10, 1989, Pat. No. 5,067,376, and Ser. No. 567,290, Aug. 14, 1990, Pat. No. 5,090,273.

[51] Int. Cl.[6] ..... B25B 13/46

[52] U.S. Cl. ..... 81/63.2; 81/58.4; 81/128

[58] Field of Search ..... 81/57.39, 60–63.2, 81/58.4, 128; 279/66, 110, 114

[56] References Cited

U.S. PATENT DOCUMENTS

| | | |
|---|---|---|
| 346,310 | 7/1886 | O'Neill . |
| 581,427 | 4/1897 | Olson . |
| 877,773 | 1/1908 | Holm . |
| 912,117 | 2/1909 | Green . |
| 915,443 | 3/1909 | Jones . |
| 1,000,277 | 8/1911 | McCoy . |
| 1,074,594 | 10/1913 | Andersen . |
| 1,243,300 | 10/1917 | Jacoby . |
| 1,274,337 | 7/1918 | Schwartz . |
| 1,291,421 | 1/1919 | Coulter . |
| 1,357,935 | 11/1920 | Argetsinger . |
| 1,410,080 | 3/1922 | Schwahlen . |
| 1,450,641 | 4/1923 | Ograbisz . |
| 1,844,616 | 2/1932 | Whiton . |
| 2,580,247 | 12/1951 | Secondi et al. . |
| 2,860,881 | 11/1958 | Perrachione . |
| 2,979,089 | 4/1961 | Piesker . |
| 3,377,893 | 4/1968 | Shorb . |
| 3,664,213 | 5/1972 | Anati . |
| 3,724,299 | 4/1973 | Nelson . |
| 4,524,649 | 6/1985 | Diaz et al. . |
| 4,722,252 | 2/1988 | Fulcher et al. . |
| 4,813,309 | 3/1989 | Kane . |
| 4,932,292 | 1/1990 | Merrick . |

FOREIGN PATENT DOCUMENTS

| | | |
|---|---|---|
| 610467 | 12/1960 | Canada . |
| 3924323 | 1/1991 | Germany . |
| WO91/01894 | 2/1991 | WIPO . |

OTHER PUBLICATIONS

"Instruction Manual" Cordless Ratchet, 6080, Black & Decker, 1988.

"Skil Operating Guide Model 2238 Cordless Power Wrench," Skill Corporation.

*Primary Examiner*—James G. Smith

[57] ABSTRACT

An adjustable ratchet wrench has a housing carried by a handle. The housing has a generally cylindrical chamber which carries a control member which in turn supports the jaws. The control member is connected to the handle by a ratchet assembly whose setting determines the direction in which the tool may be used to turn a workpiece. The housing also carries a cam disk that engages the jaws and opens and closes them depending upon the direction in which it is rotated. A locking mechanism is provided to prevent the jaws fro opening after they have been adjusted to grip a particular workpiece in response to reactive forces on the jaws. The wrench may also have a powered handle to drive the workpiece.

40 Claims, 27 Drawing Sheets

ADJUSTABLE WRENCH

RELATED APPLICATIONS

This application is a continuation of application Ser. No. 07/871,845 filed Apr. 21, 1992, now U.S. Pat. No. 5,305,670, which application is a continuation-in-part of prior application Ser. No. 07/638,828 filed Jan. 8, 1991, now abandoned, which in turn is a continuation-in-part of prior applications Ser. No. 07/387,220 filed Jul. 28, 1989, now abandoned, Ser. No. 07/392,206 filed Aug. 10, 1989, now U.S. Pat. No. 5,067,376 dated Nov. 26, 1991 and Ser. No. 07/567,290 filed Aug. 14, 1990, now U.S. Pat. No. 5,090,273. Co-applicant Gregory Fossella is the sole inventor in all of the above-identified patents and applications. The disclosures of these applications is incorporated herein by reference.

INTRODUCTION

This invention relates to adjustable wrench heads. The invention may be embodied in either a manually operated wrench or a wrench having a power handle which allows it to be operated both manually and automatically. The wrench head also has application in modular tools with square drives, ratchet handles etc.

The present invention is an improvement over the adjustable wrenches shown in the earlier applications identified above. The wrenches in the earlier applications, supra, are all capable of use with a large range of sizes of nuts and bolts. In the previous application Ser. No. 07/387,220, filed Jul. 28, 1989, an adjustable wrench is disclosed that will accommodate both standard and metric sizes within the range of 5/16th to 1 inch in diameter. A similar range of sizes is accommodated by the extension wrench shown in the application Ser. No. 07/392,206, filed Aug. 10, 1989. Most conventional ratchet and extension wrenches in use today require a large number of interchangeable heads to accommodate workpieces of different diameters. For example, approximately 41 different heads are required to accommodate both standard and metric sizes within the range of from 5/16th to 1 inch in diameter. An additional equal number of heads may be required if deep bolt clearance is necessary to perform the work.

The principle object of the present invention is to provide an adjustable wrench head capable of accommodating a wide range of sizes of nuts and bolts.

Another important object of the present invention is to provide an adjustable wrench head which is suitable for use in manual and power tools, and also is suitable for use both as the working head of an extension wrench as well as a ratchet wrench.

Another important object of the present invention is to provide an adjustable wrench head which is relatively small, has relatively few parts, and is stronger and less dependent on tight tolerances than the wrench heads of the prior applications supra.

Yet another important object of the present invention is to provide an adjustable wrench head in which the jaws of the wrench may be adjusted to a particular bolt size and locked in position.

To accomplish these and other objects, the adjustable wrench head of the present invention includes a generally cylindrical housing open at the bottom and at the top, and includes at least two gripping jaws which extend out the open bottom. A control disk is disposed inside the housing and engages the upper ends of the jaws so as to confine the motion of the jaws to a radial direction with respect to the control disk. The control disk in turn may be selectively locked to the housing with a ratchet assembly which prohibits relative rotation of the control disk with respect to the housing in the selected direction. An adjusting disk in one embodiment is disposed beneath the control disk and is mounted for rotation relative to the housing. The adjusting disk extends out the bottom of the housing and it has a gripping ring which facilitates its rotation by the tool user. In the preferred embodiment of this invention, the control disk or member has a flange that supports the adjusting disk from beneath. The adjusting disk surrounds the jaws, and the jaws and adjusting ring have mating cam surfaces which cause the jaws to move radially toward or away from the housing axis (to close or open the jaws) when the adjusting disk is rotated. One or more additional cam surfaces is provided on the adjusting disk and the jaws to stabilize them in the housing and prevent the jaws from canting when pressure is applied to their gripping faces by the workpiece engaged by them.

A locking device is provided for engagement with either the adjusting disk or the control disk to lock the jaws of the wrench in a desired position once they contact the workpiece. In the locked state, the jaws will not open in response to reactive forces applied to the jaws by the workpiece as it is turned by the tool.

In one embodiment of the present invention, the housing carries a radially extending handle by which the tool may be turned to rotate the work engaged by the jaws.

In accordance with other embodiments of this invention, the housing is provided with a handle which not only may function to turn the tool manually, but also contains a power pack for automatically driving the tool. In one embodiments the control member is continuously rotated by a motor in the handle, and in the preferred embodiment the control member is turned stepwise by motor.

In accordance with other embodiments of this invention, the control disk may be part of the housing and include means for connecting the head to a square drive, ratchet drive or other inputs.

In yet another embodiment of the present invention, a locking pawl extends out of a recess in the adjusting disk and engages the control disk to limit the radial movement of the jaws.

In accordance with yet another embodiment of this invention radial movement of the jaws is limited by a locking pawl disposed in a recess in the control disk and which engages the adjusting disk.

In still another embodiment of the invention, the jaws of the wrench are locked by a wave washer disposed between the housing and the control disk to bias the control disk vertically downward so that teeth on the bottom of the control disk engage a top gear on the adjusting disk.

In another embodiment of the invention, a lock release mechanism is provided, which extends through the center of a reversing pawl lever located on the top of the housing so that upon depression of a plunger, a locking device in the form of a gear is disengaged from a gear extending upwardly from the adjusting disk.

These and other objects and features of the present invention will be better understood and appreciated from the following detailed description of several embodiments thereof, selected for purposes of illustration and shown in the accompanying drawings.

BRIEF FIGURE DESCRIPTION

Figure 2:
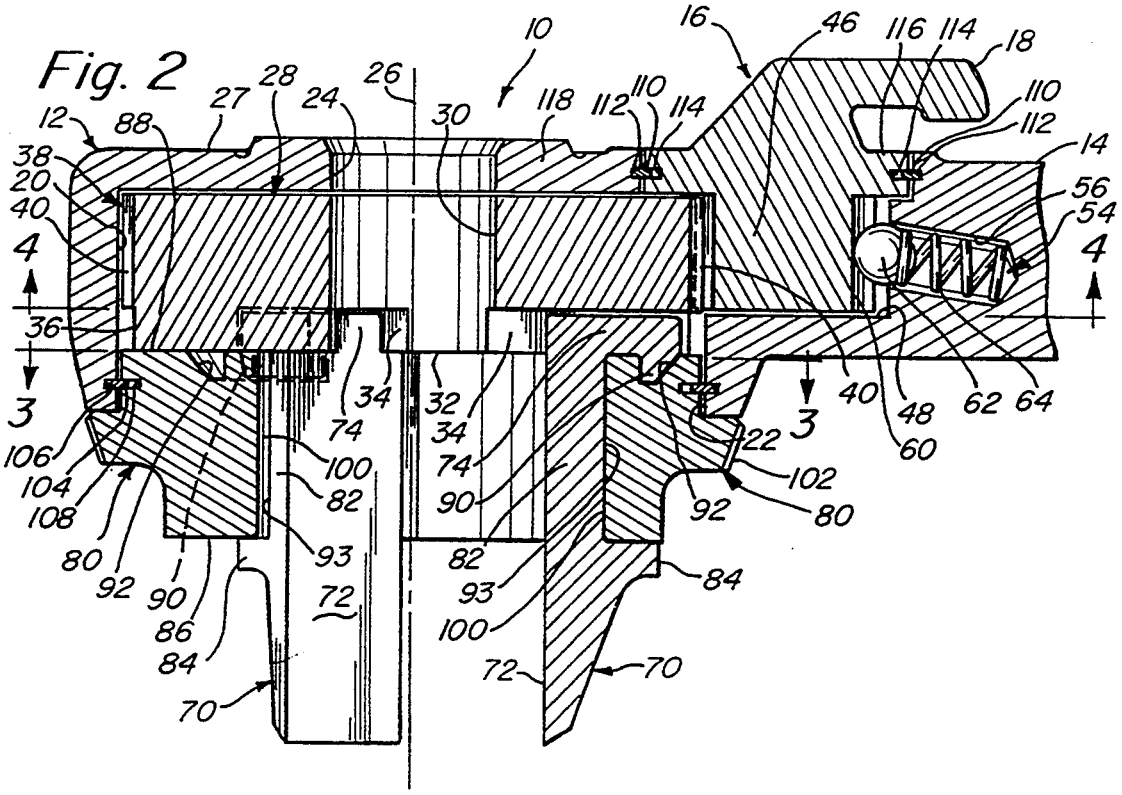
FIG. 2 is a vertical cross-sectional view of the ratchet wrench of FIG. 1 taken across a diameter of the wrench head.
Figure 3:
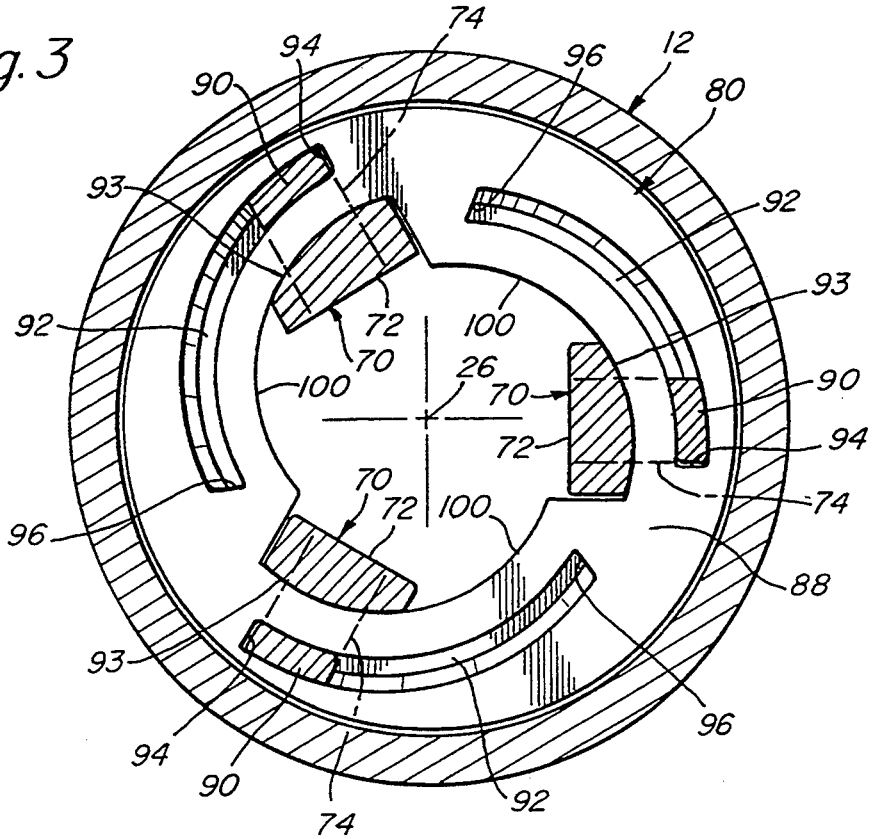
Figure 4:
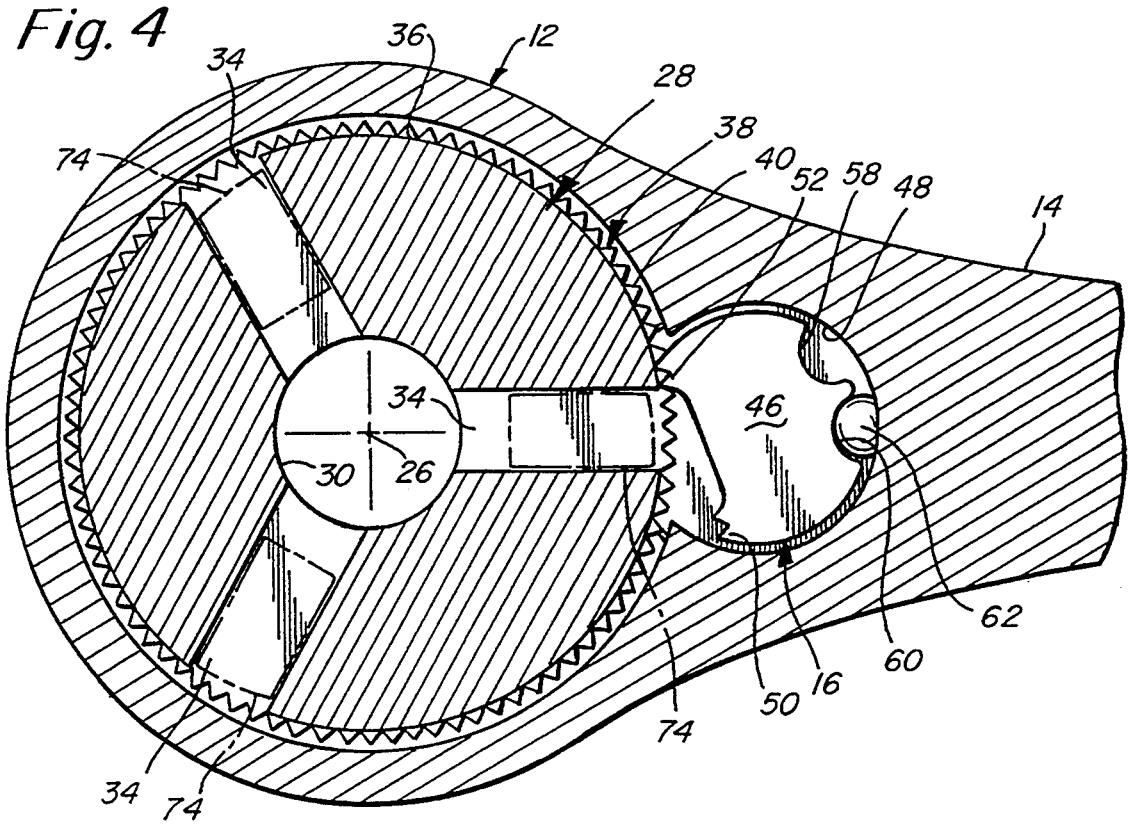
Figure 5:
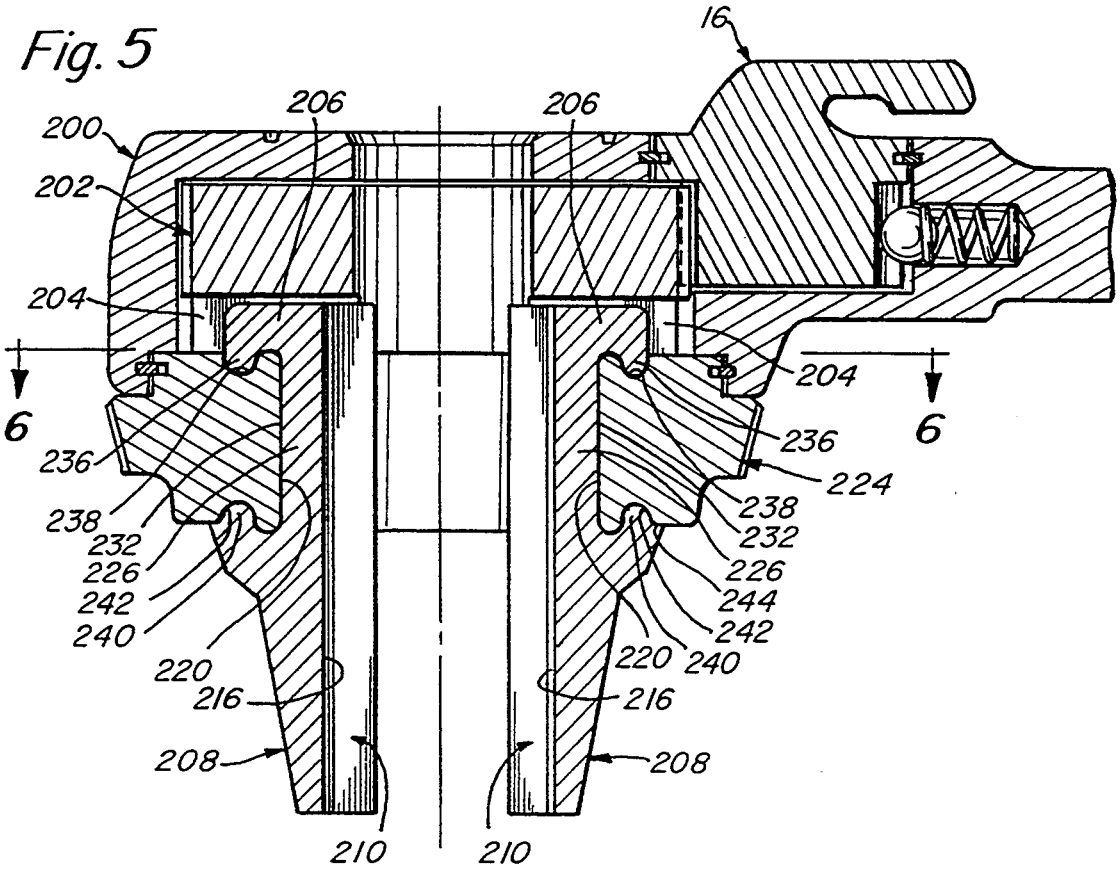
Figure 6:
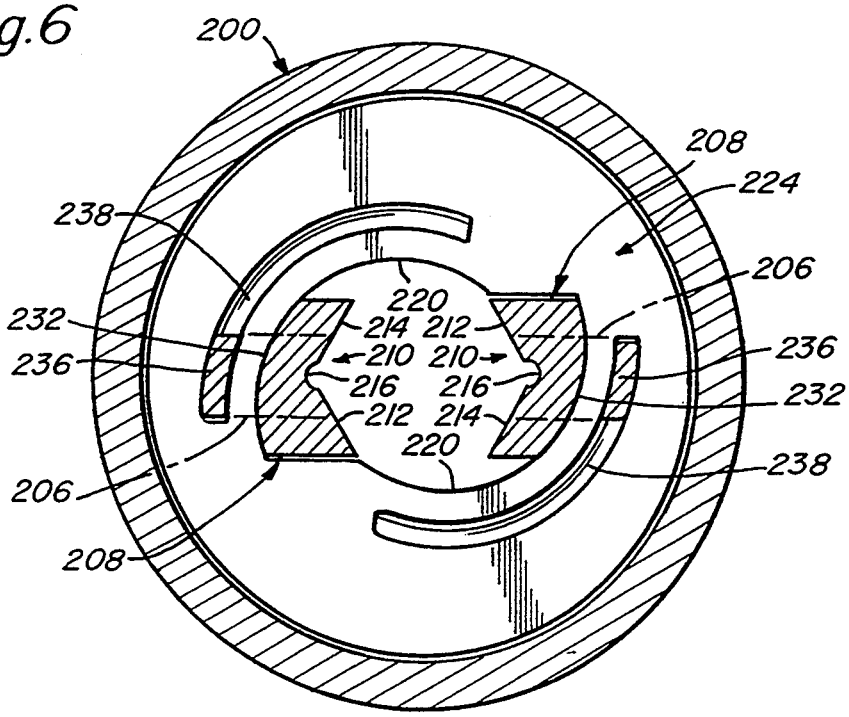
Figure 7:
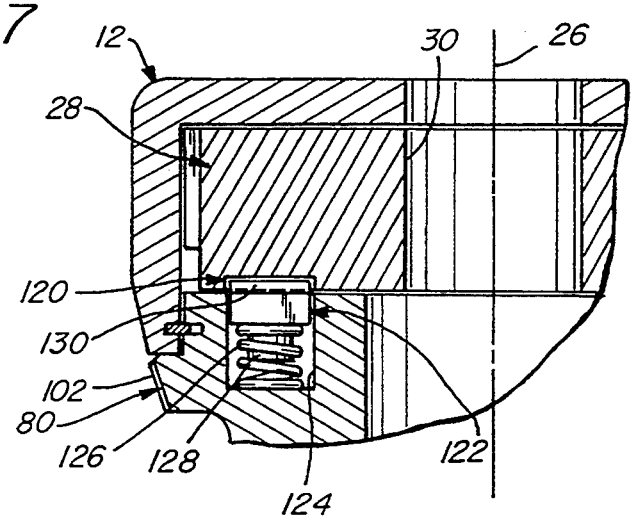
Figure 8:
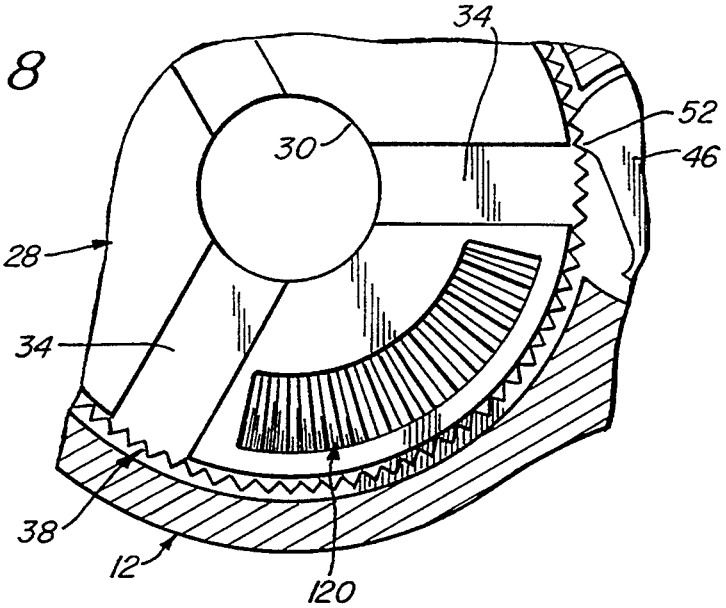
Figure 9:
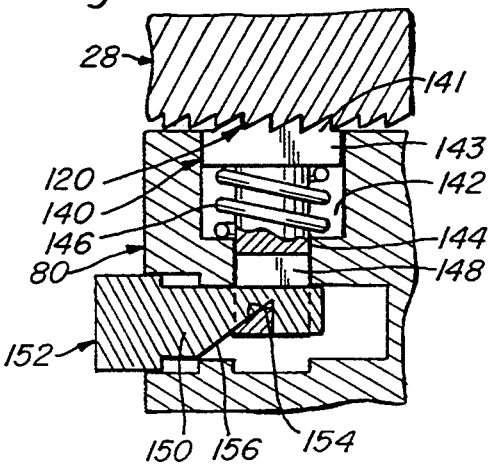
Figure 10:
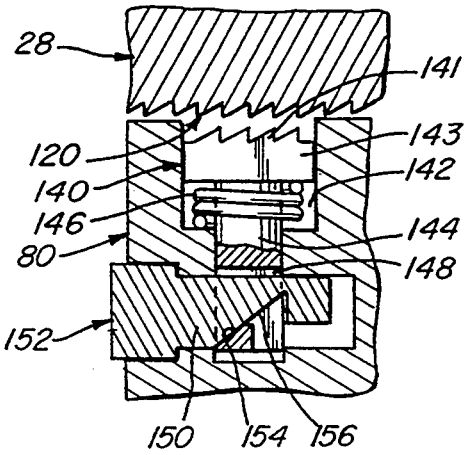
Figure 11:
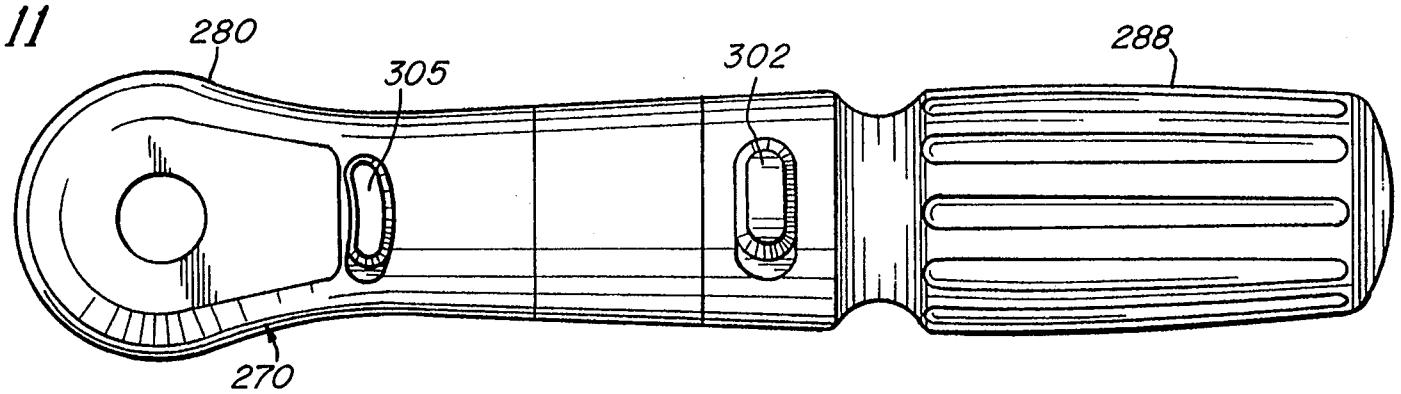
Figure 12:
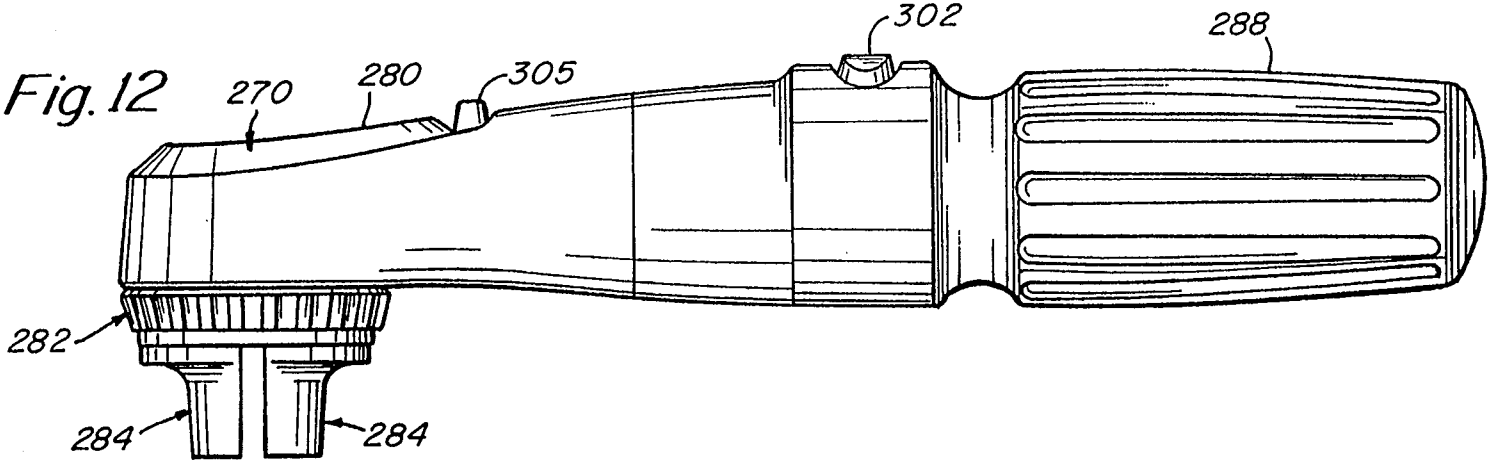
Figure 13:
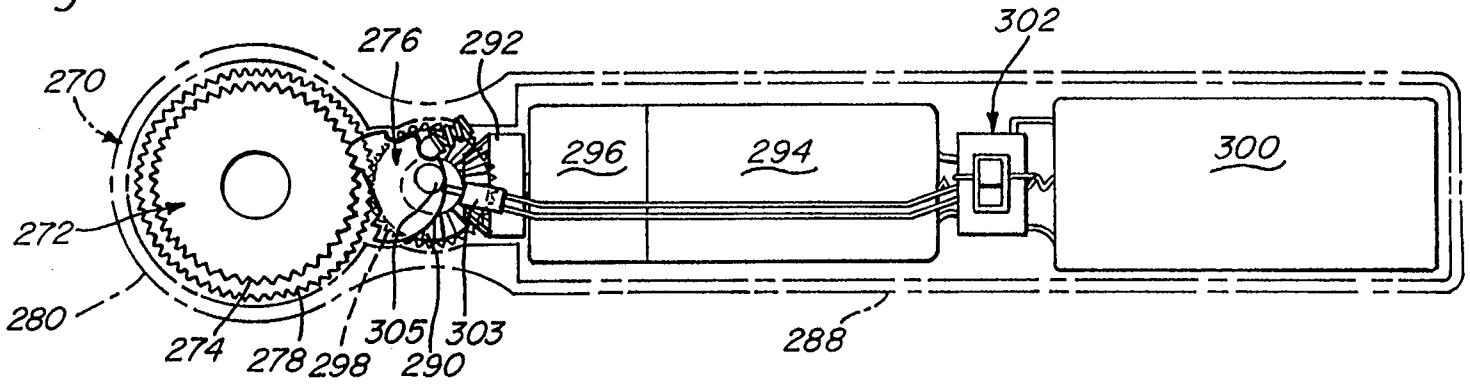
Figure 14:
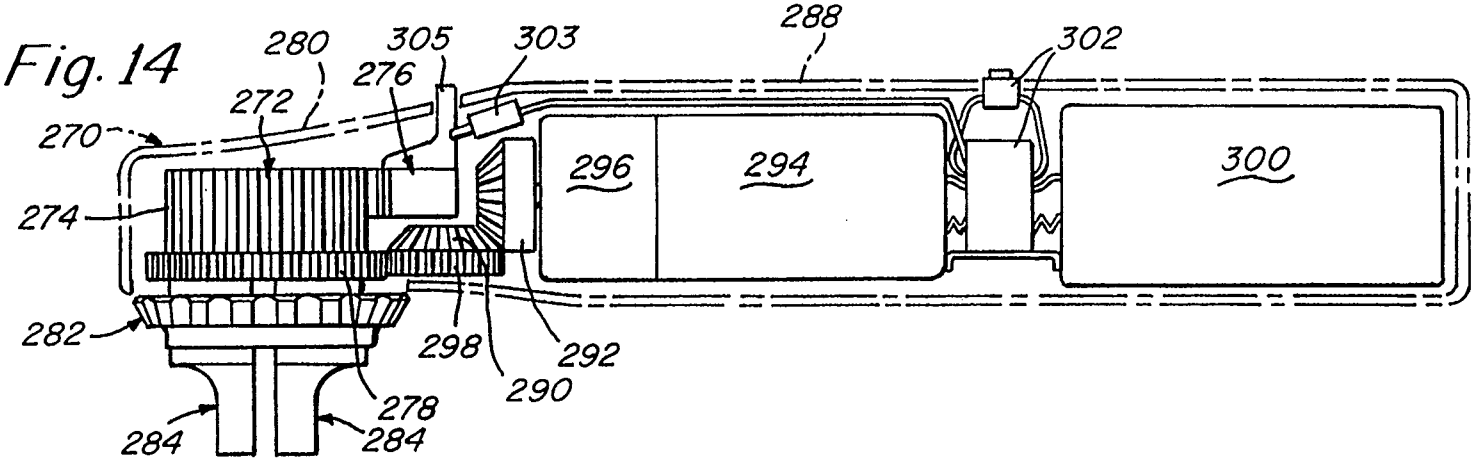
Figure 15:
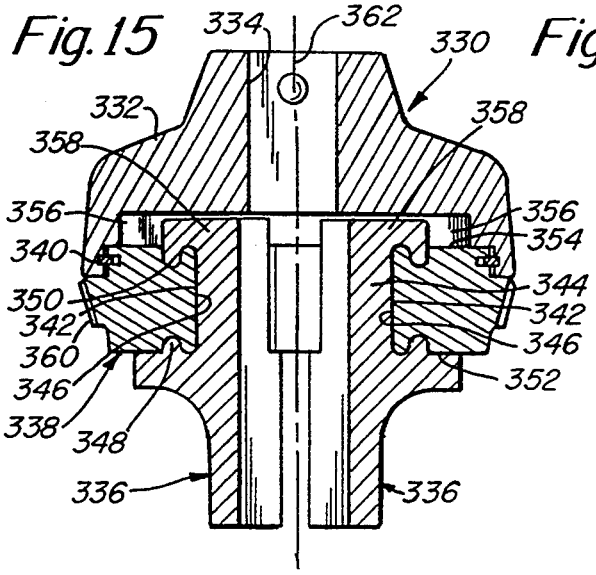
Figure 16:
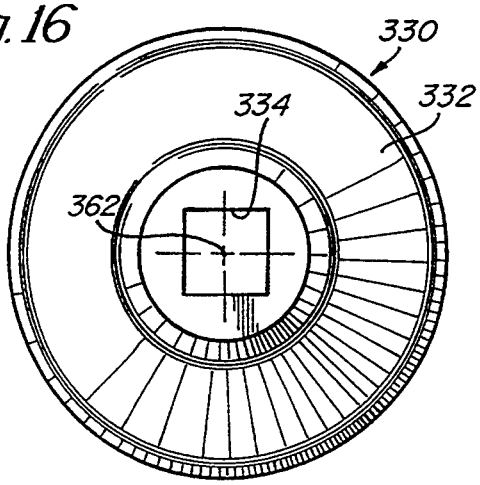
Figure 17:
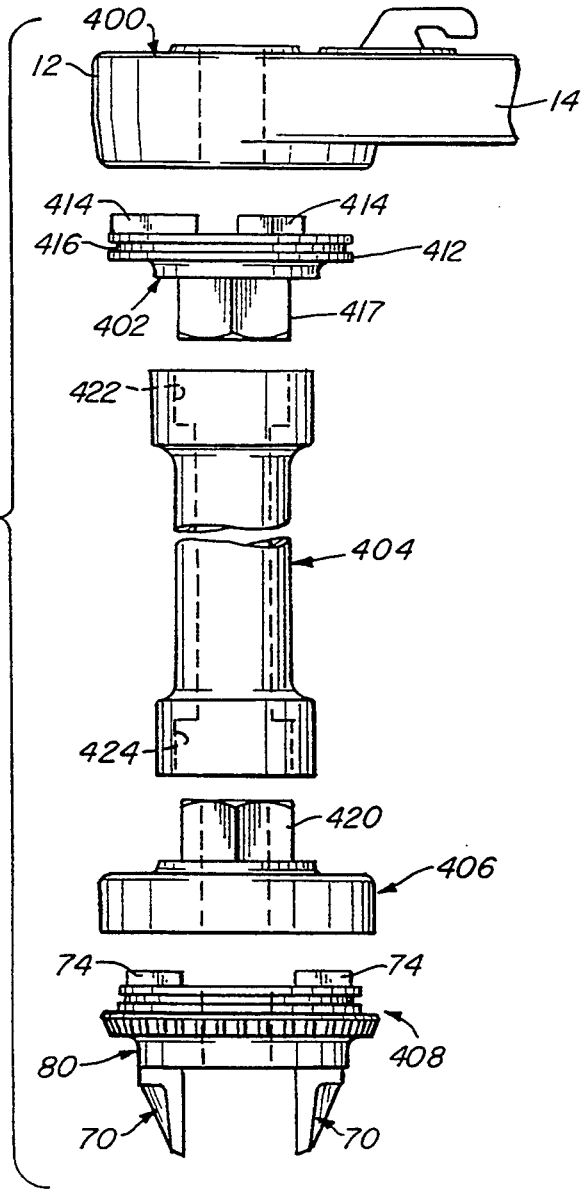
Figure 18:
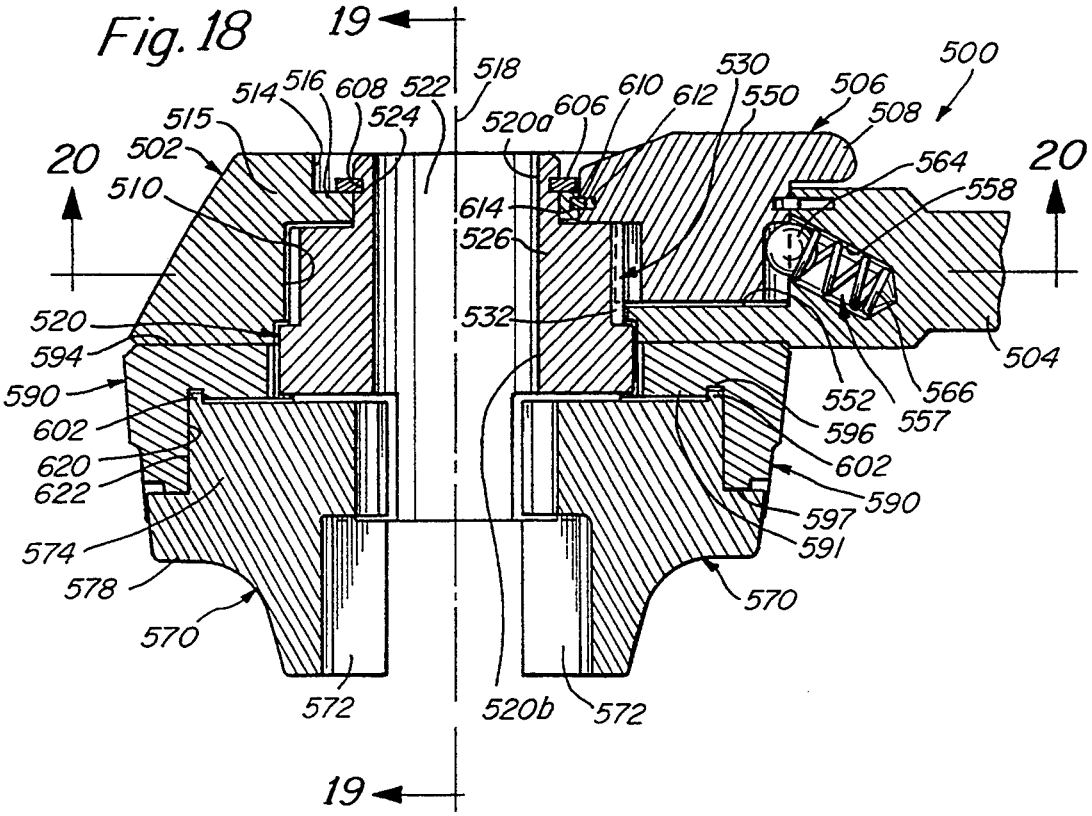
Figure 19:
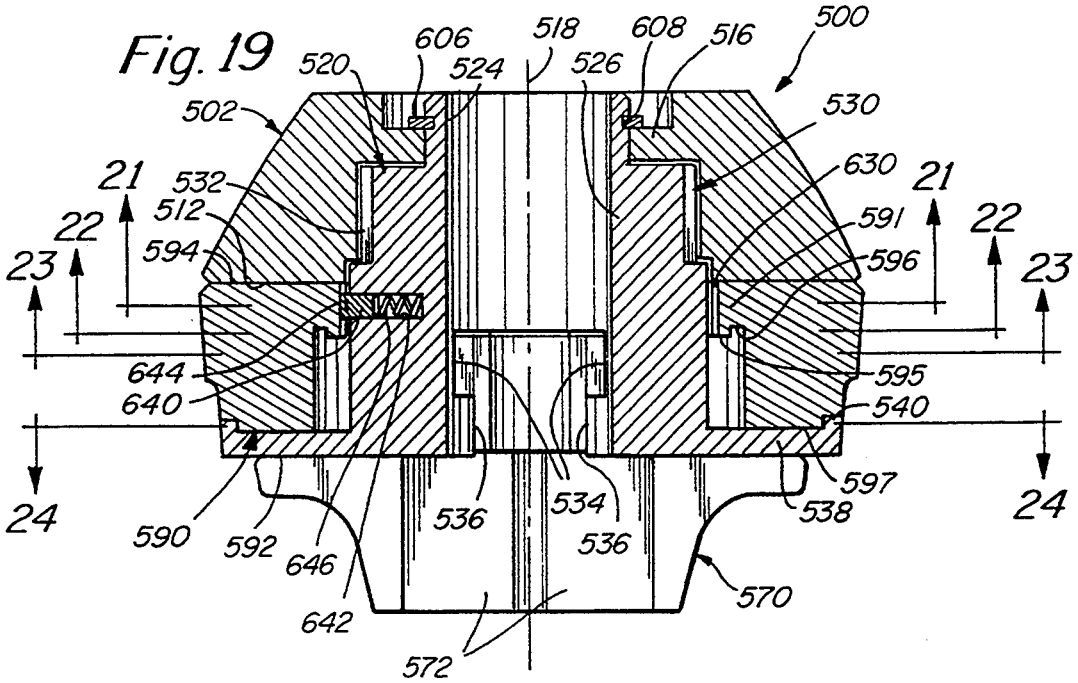
Figure 20:
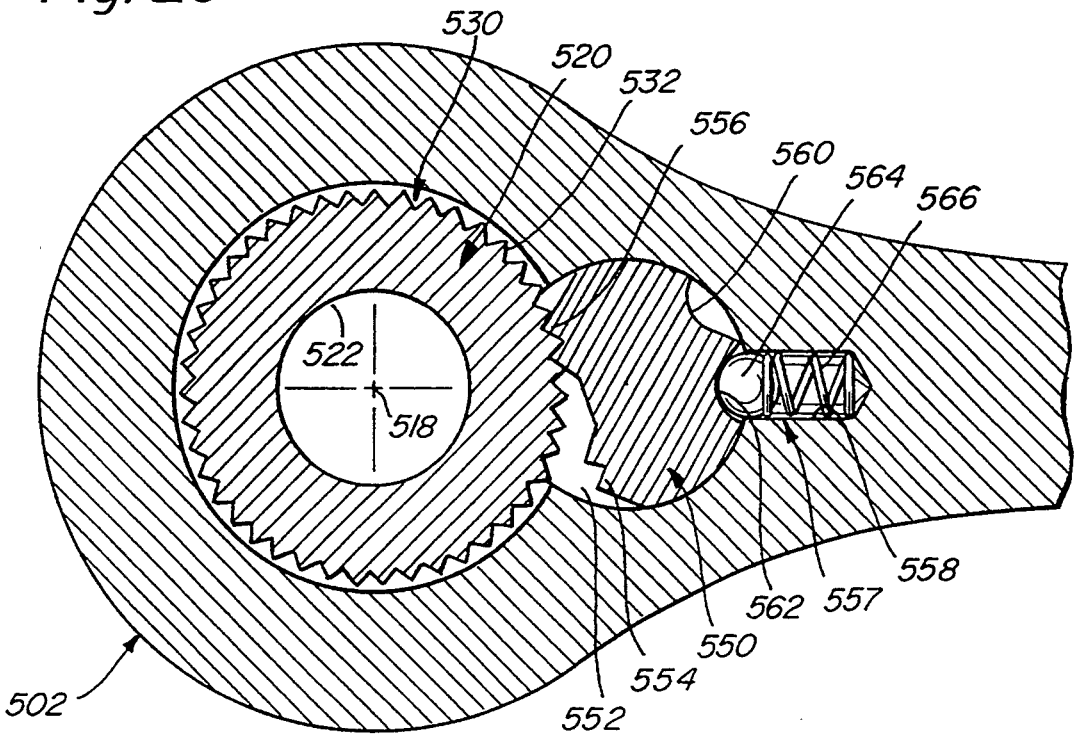
Figure 25:
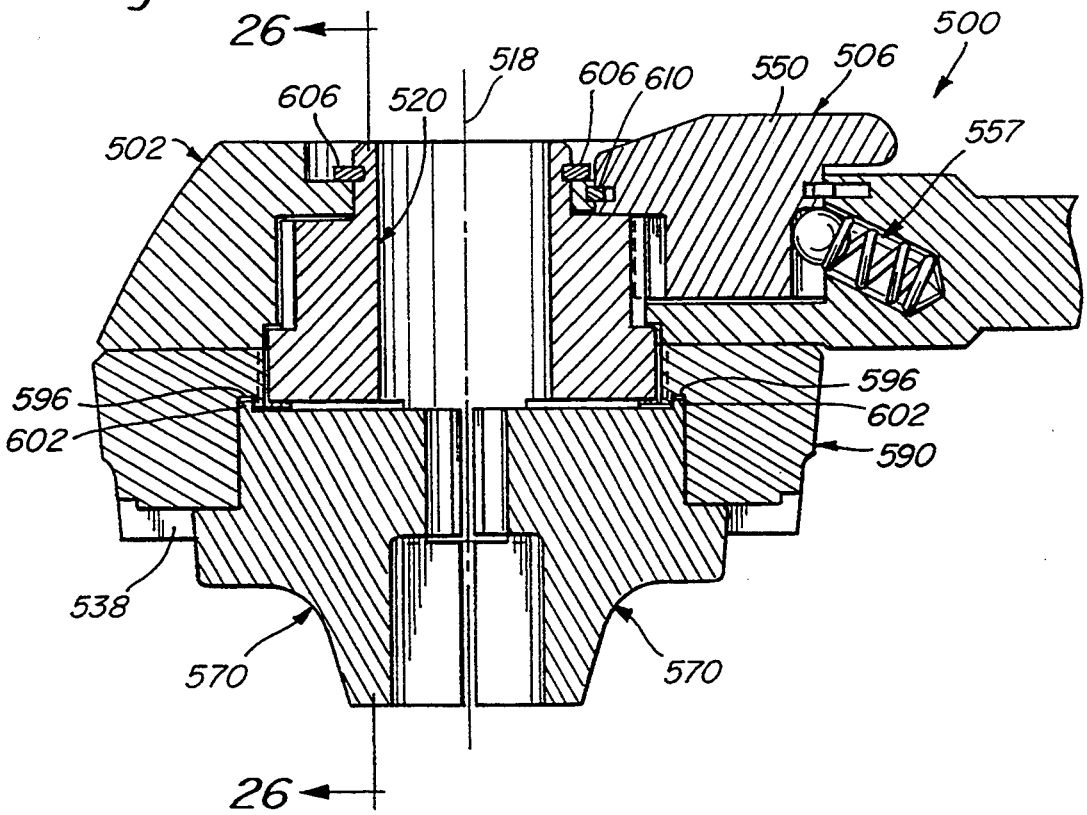
Figure 26:
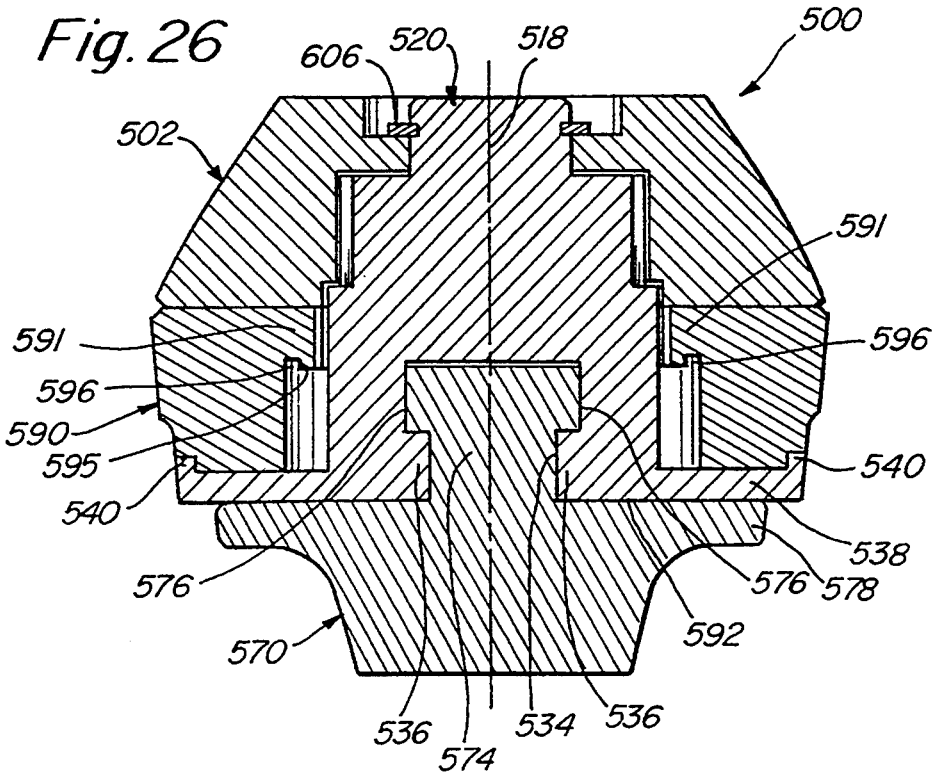
Figure 27:
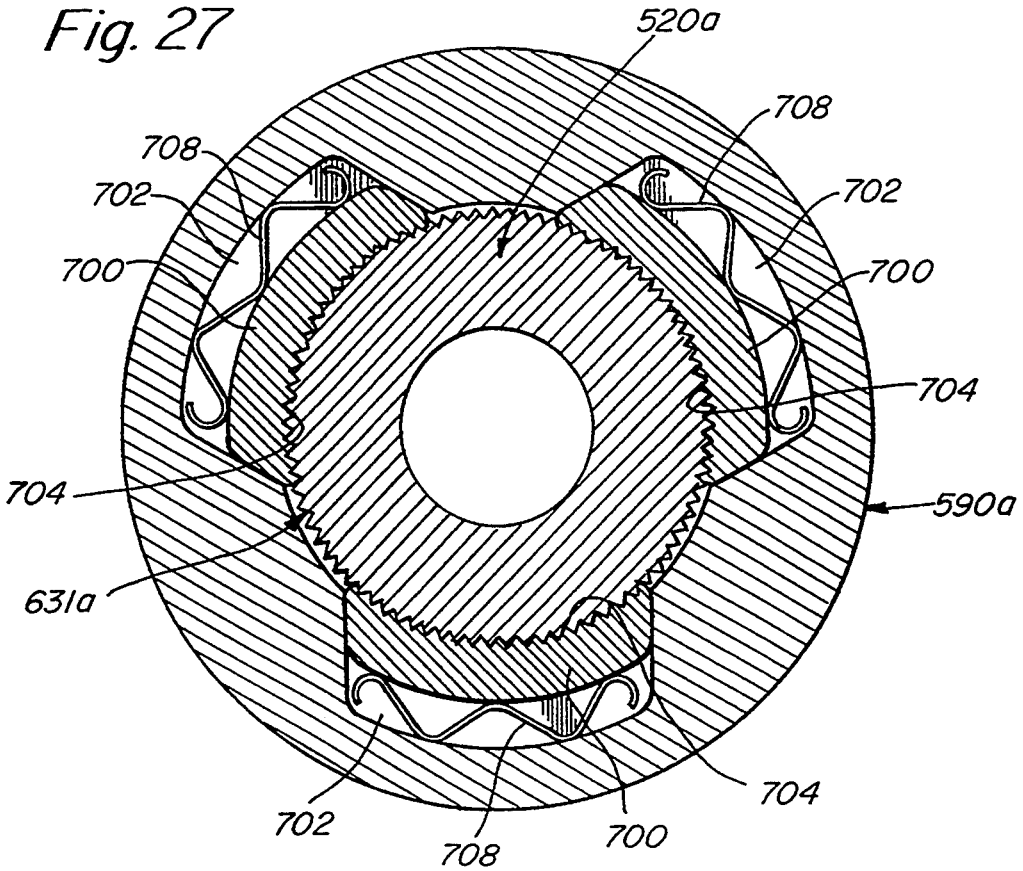
Figure 28:
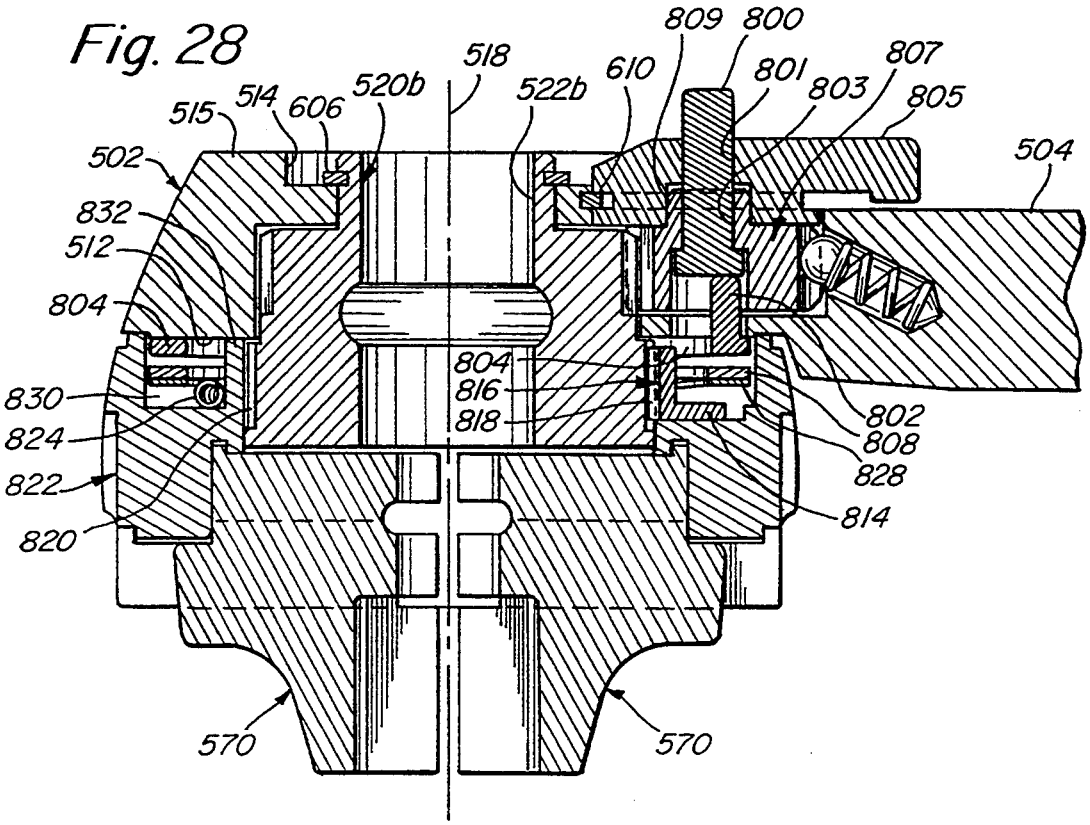
Figure 29:
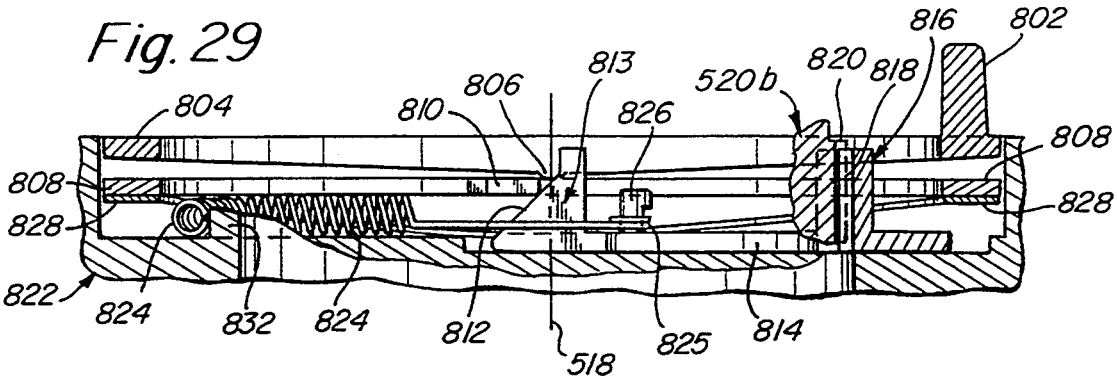
Figure 30:
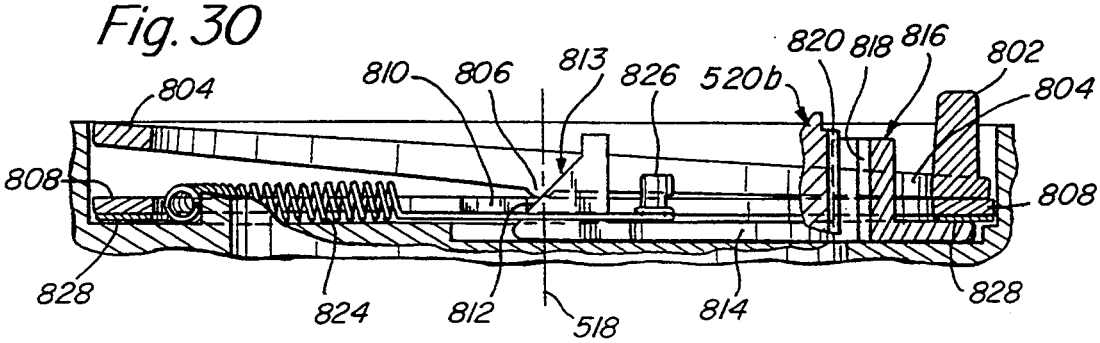
Figure 31:
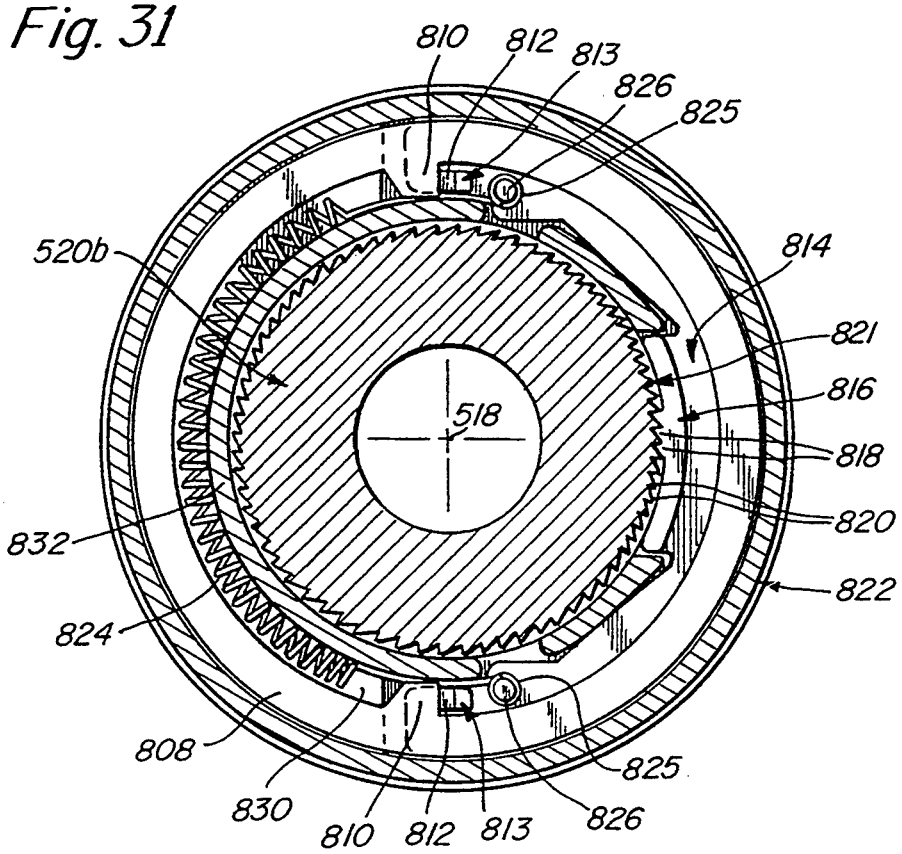
Figure 32:
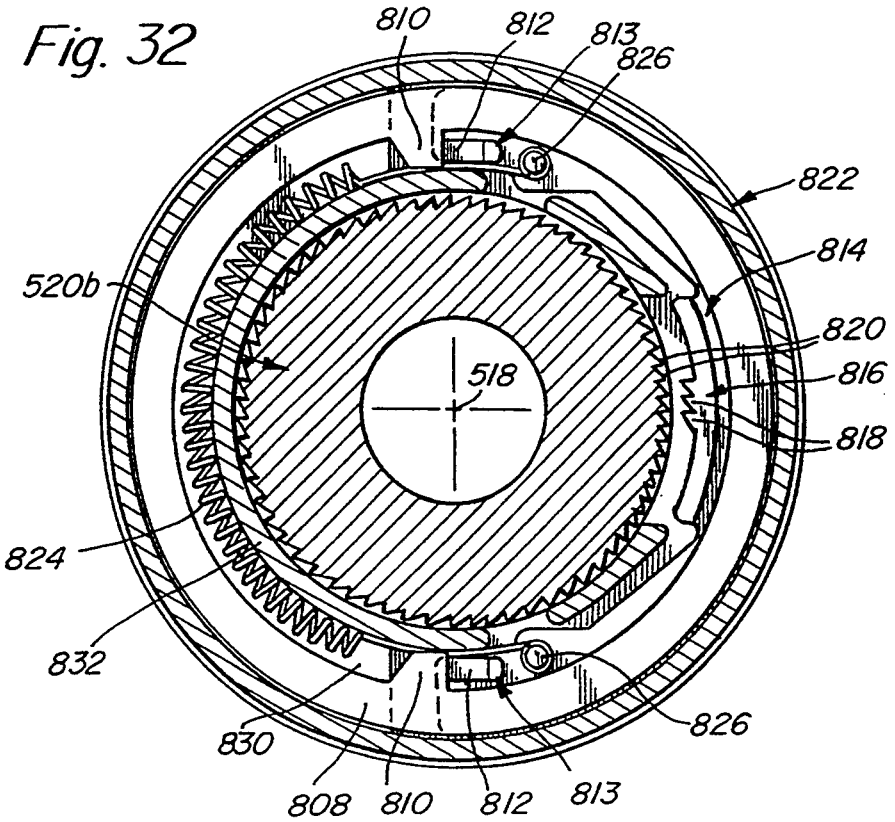
Figure 33:
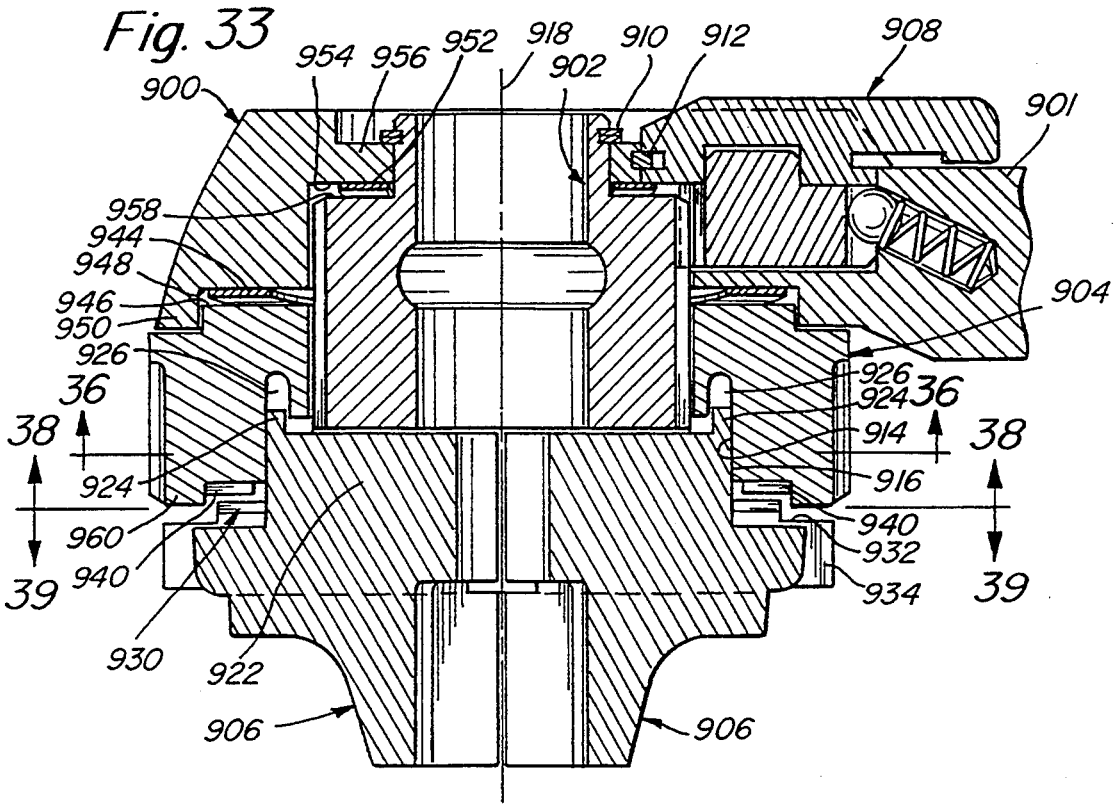
Figure 34:
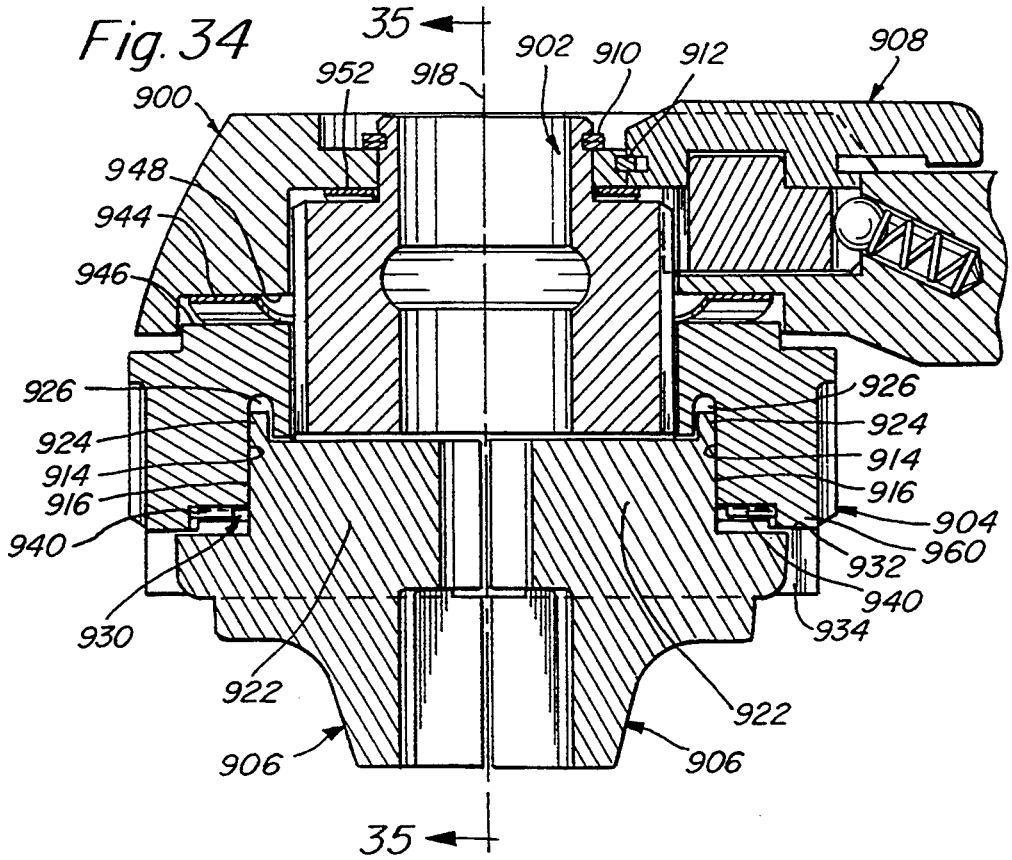
Figure 35:
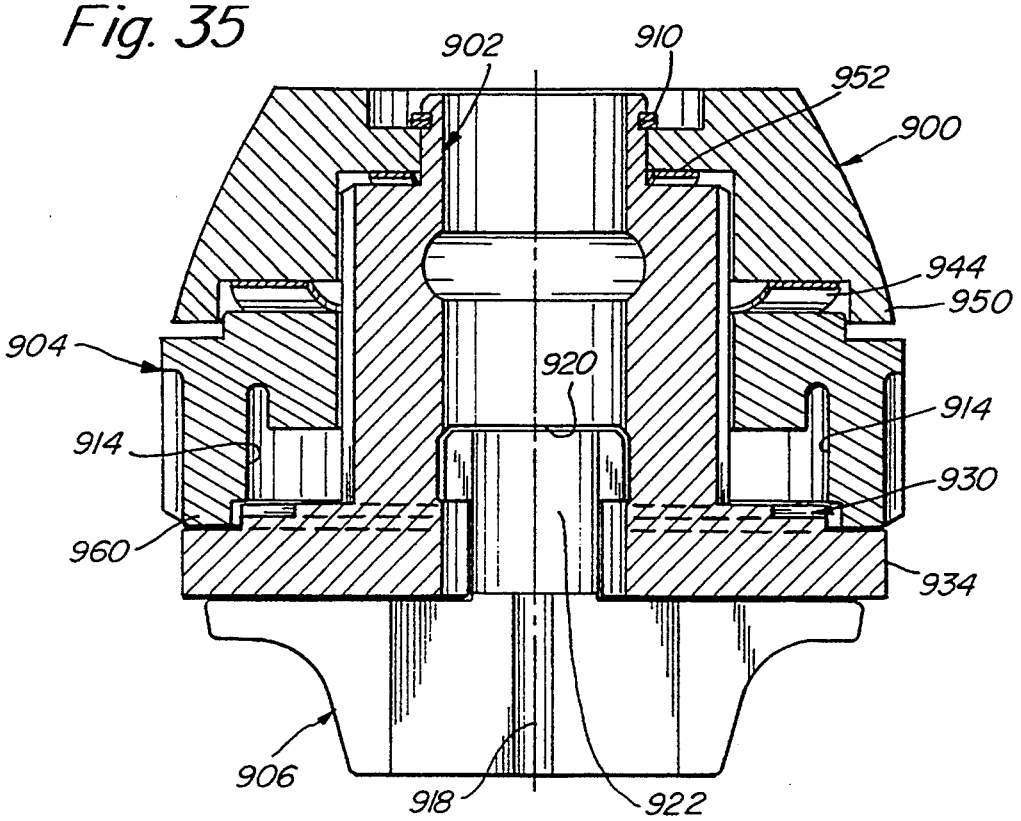
Figure 36:
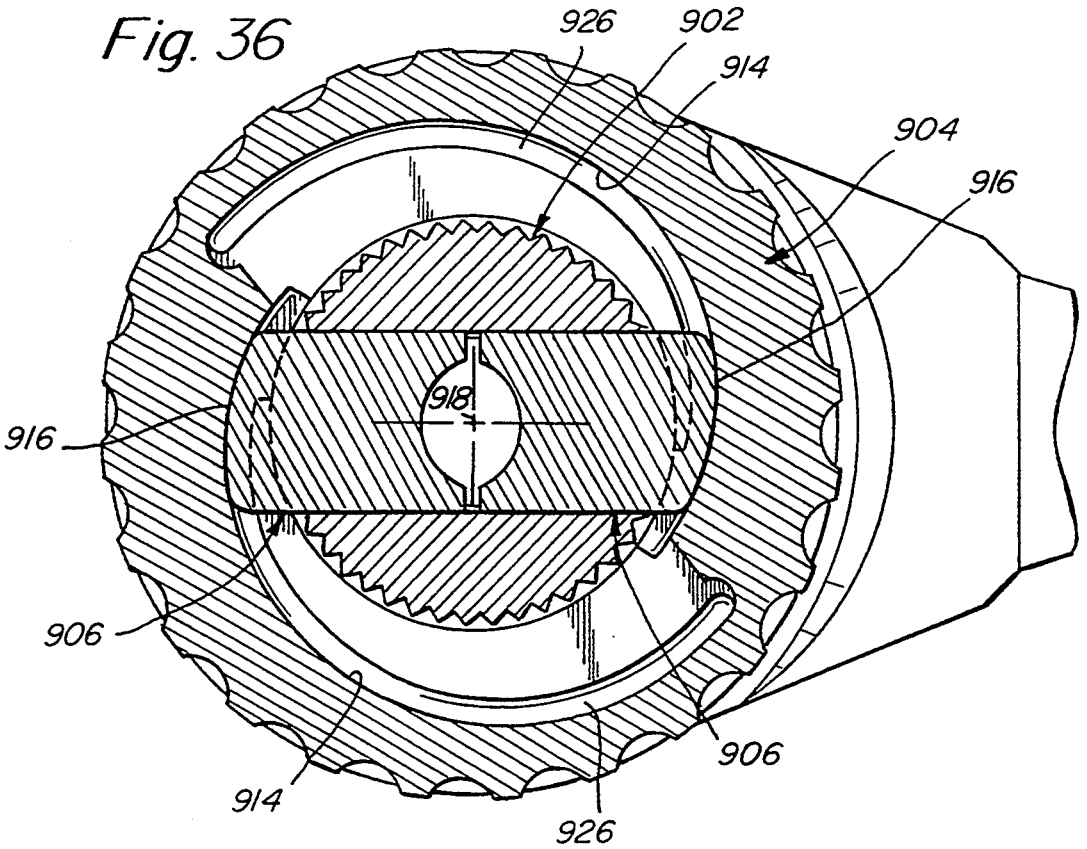
Figure 37:
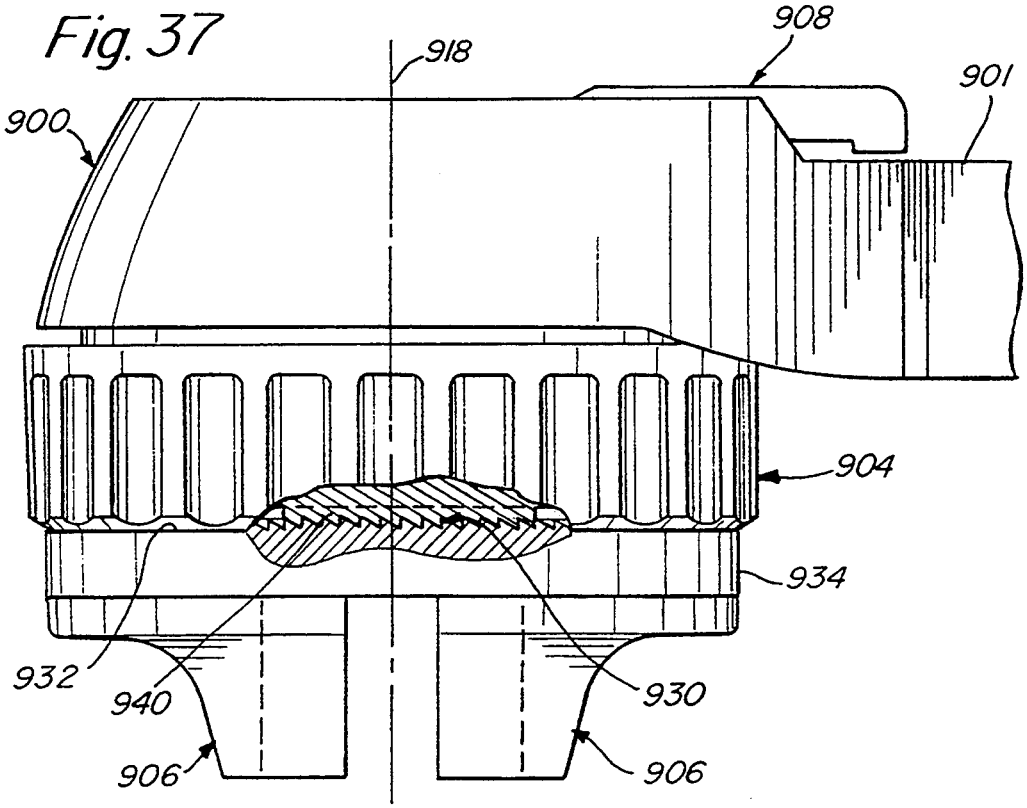
Figure 38:
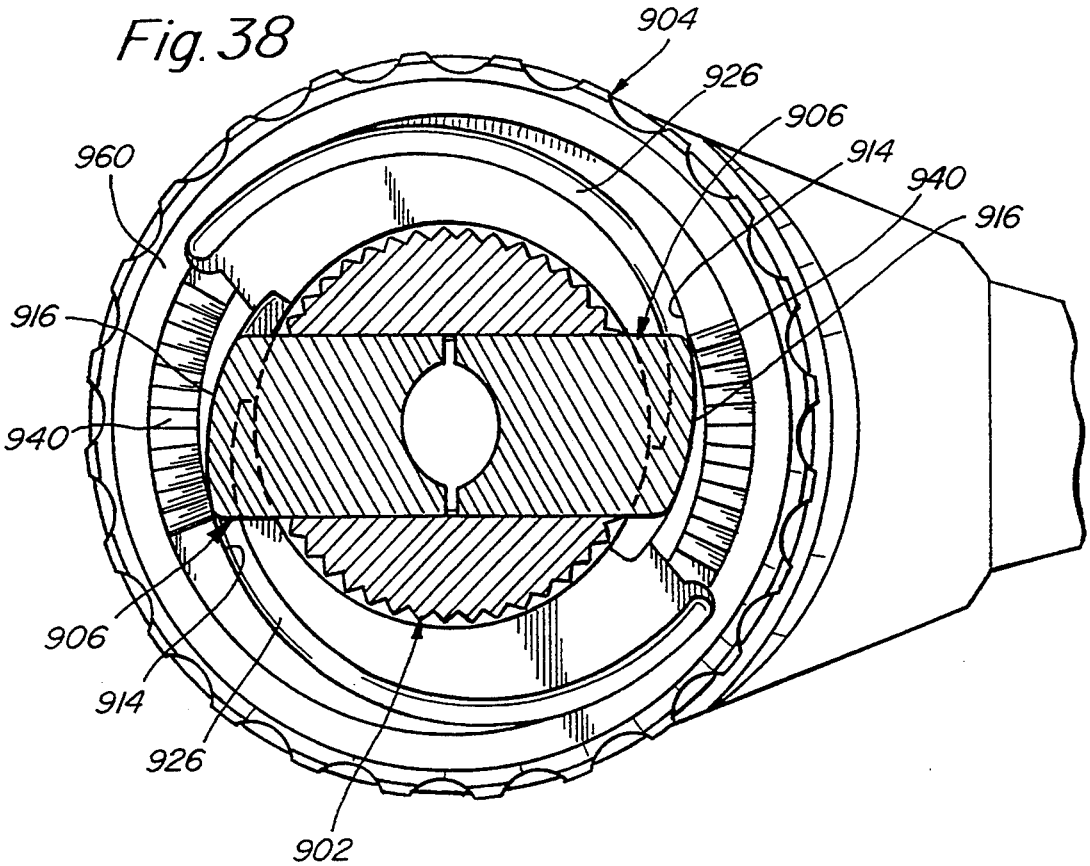
Figure 39:
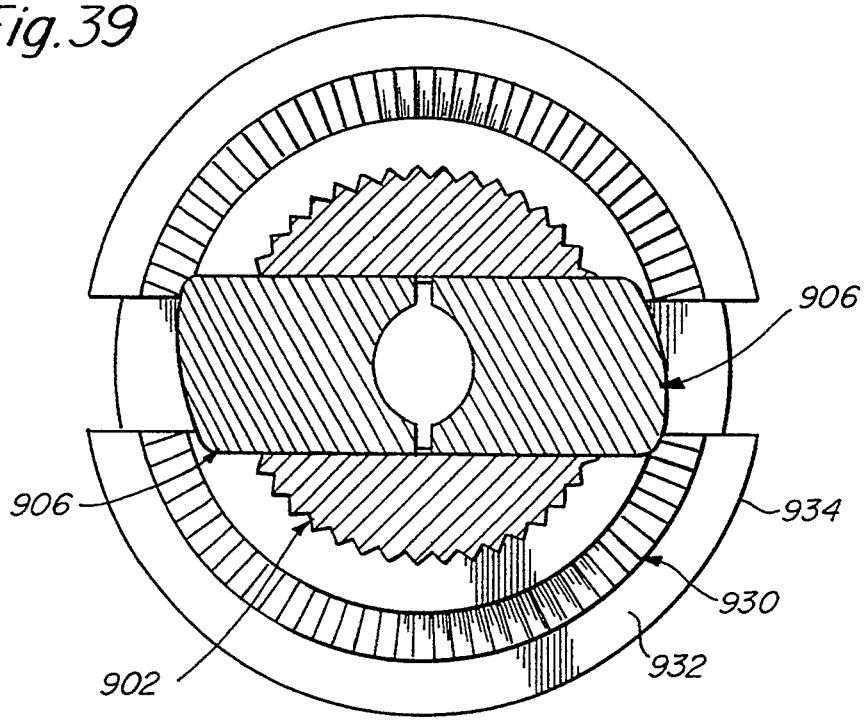
Figure 40:
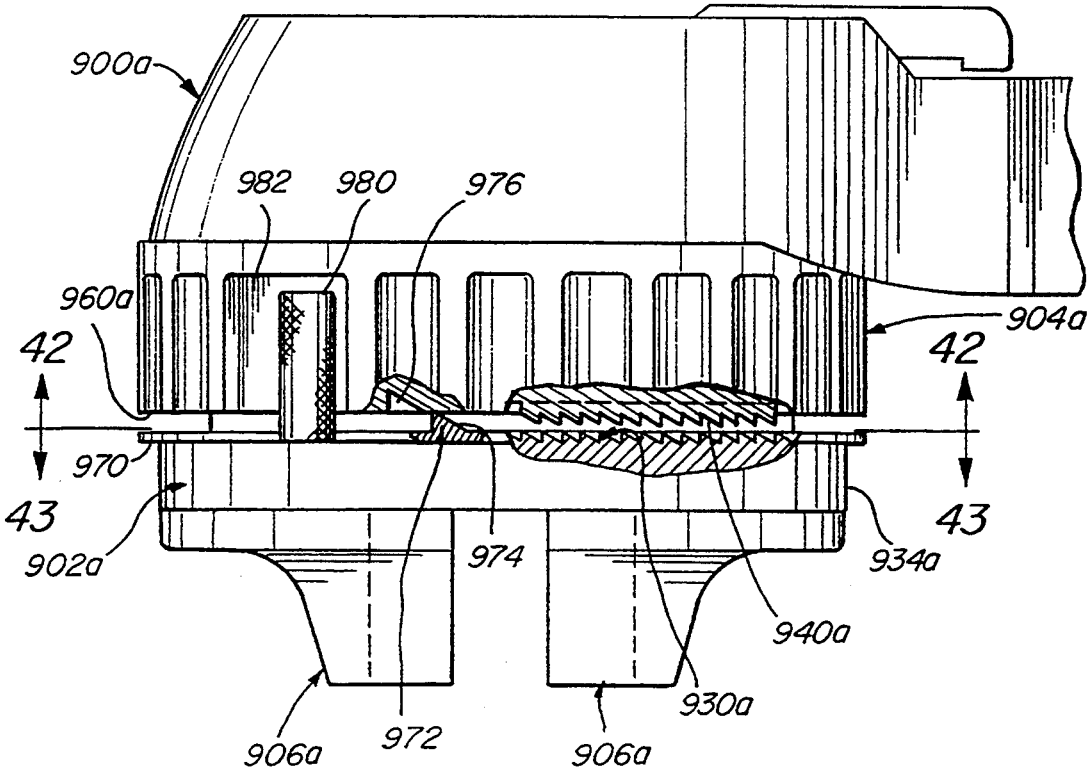
Figure 41:
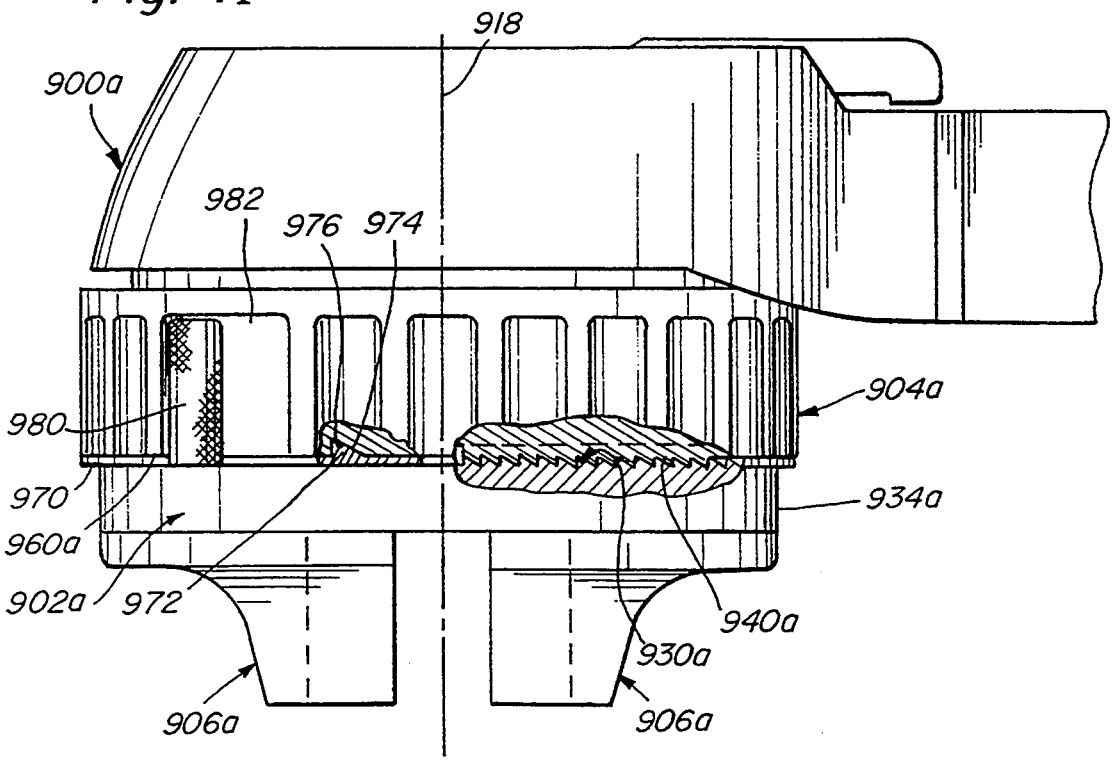
Figure 42:
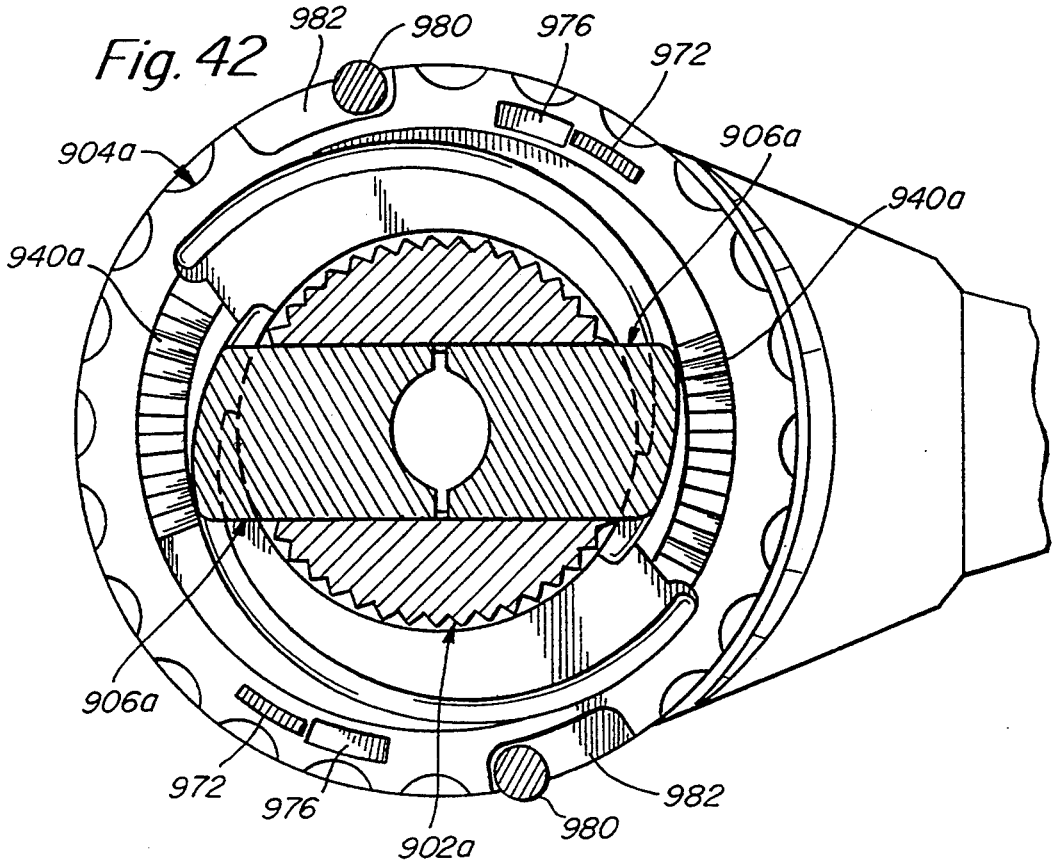
Figure 43:
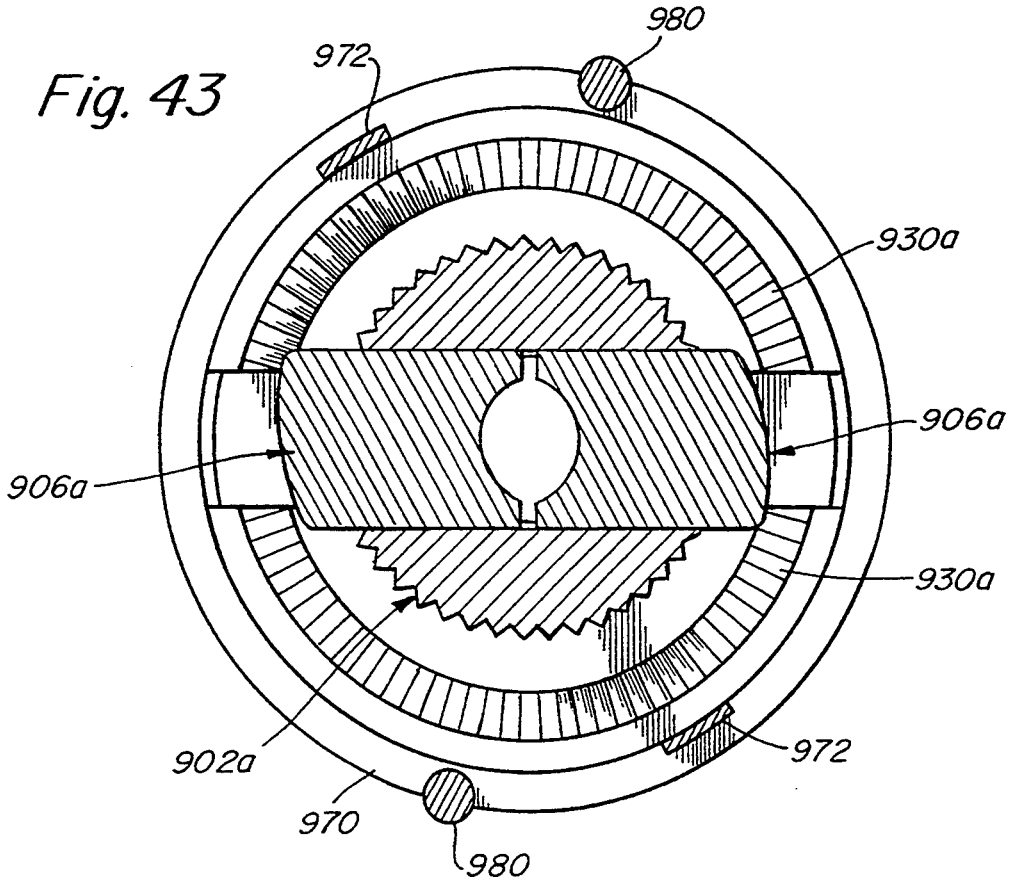
Figure 44:
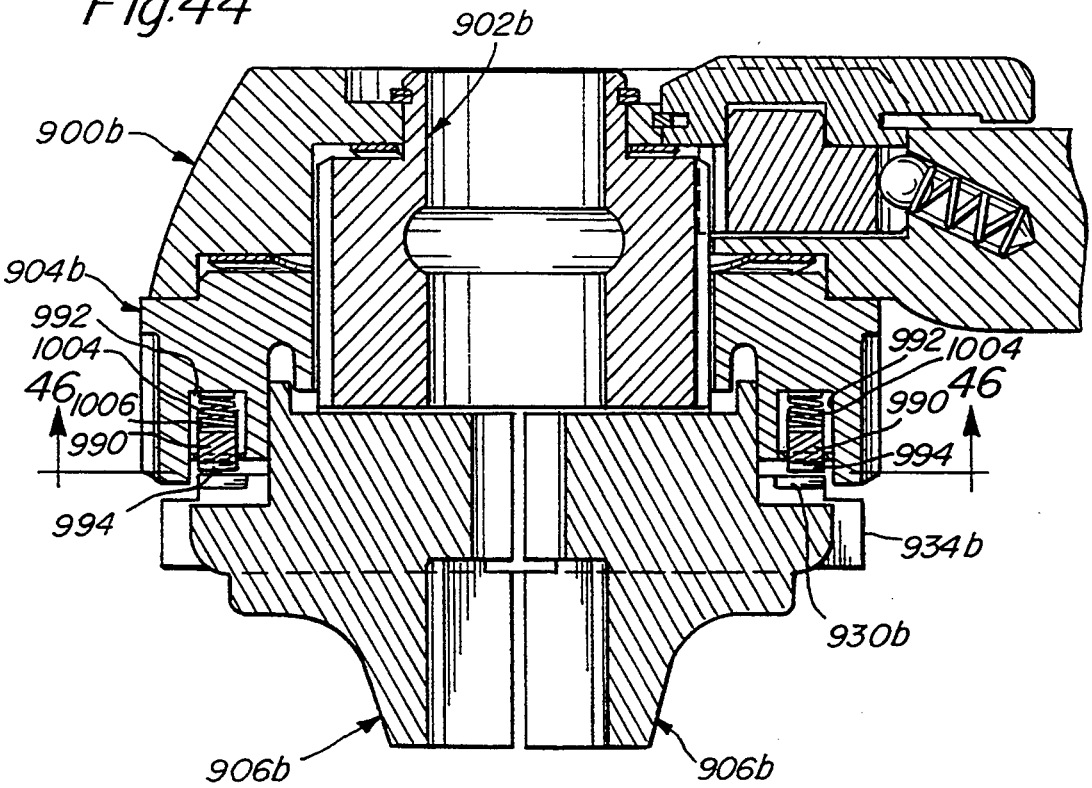
Figure 45:
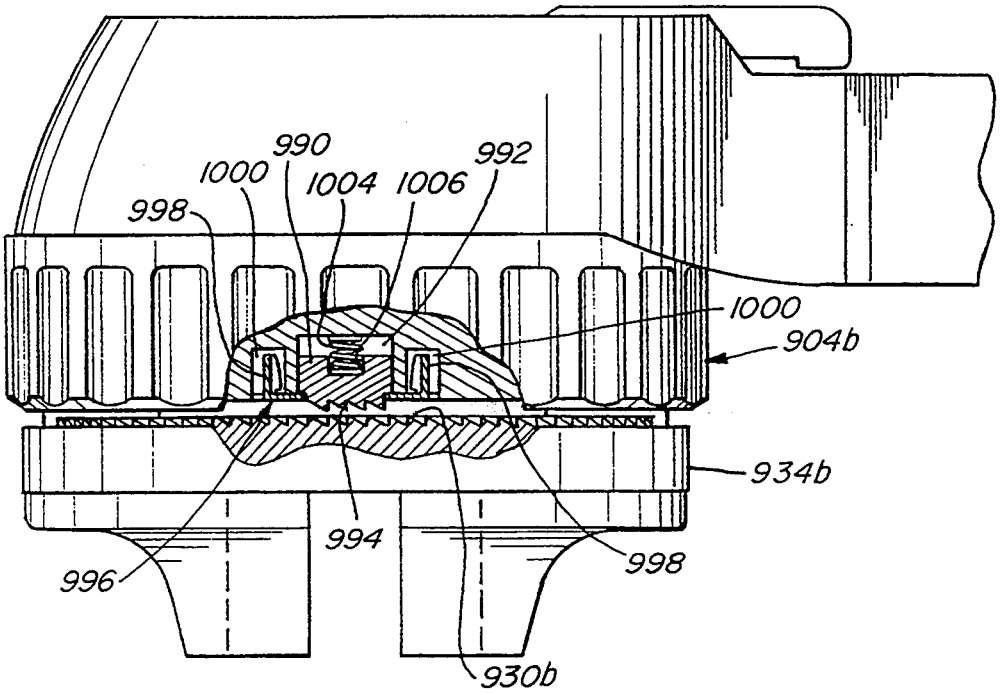
Figure 46:
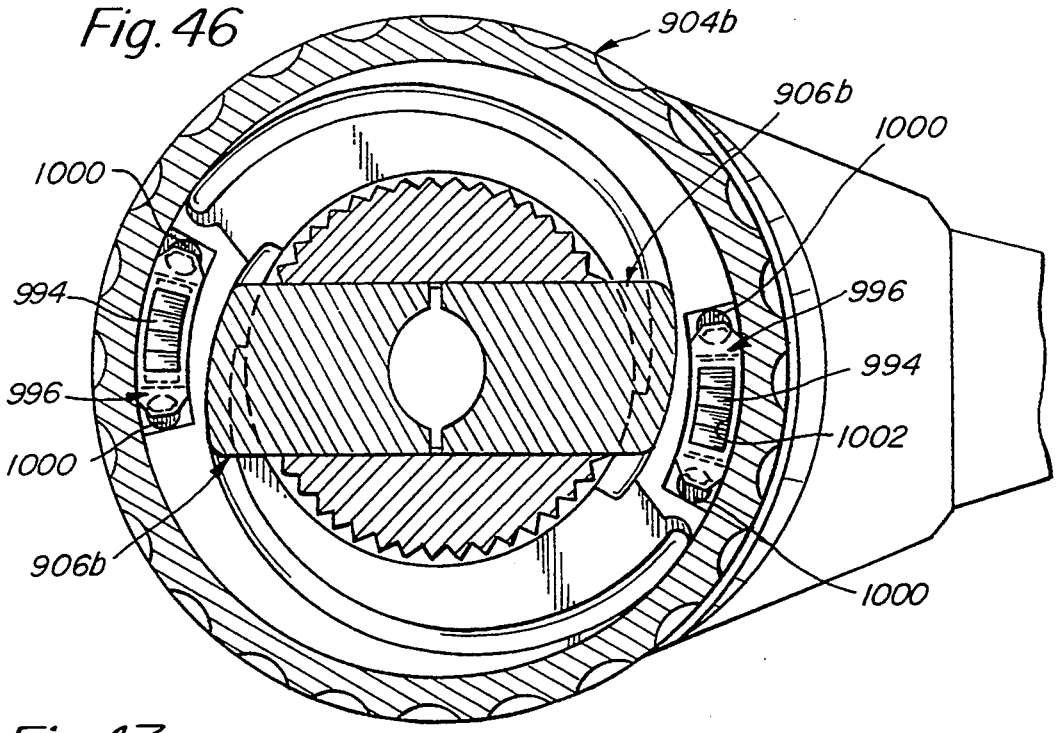
Figure 47:
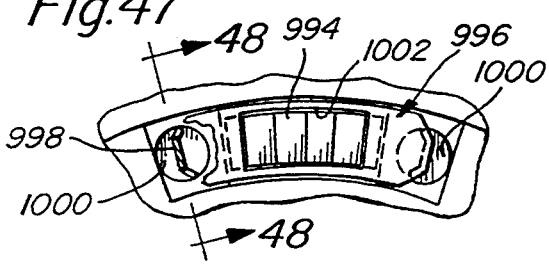
Figure 48:
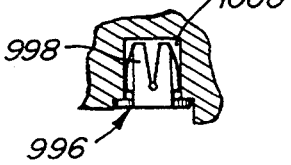
Figure 49:
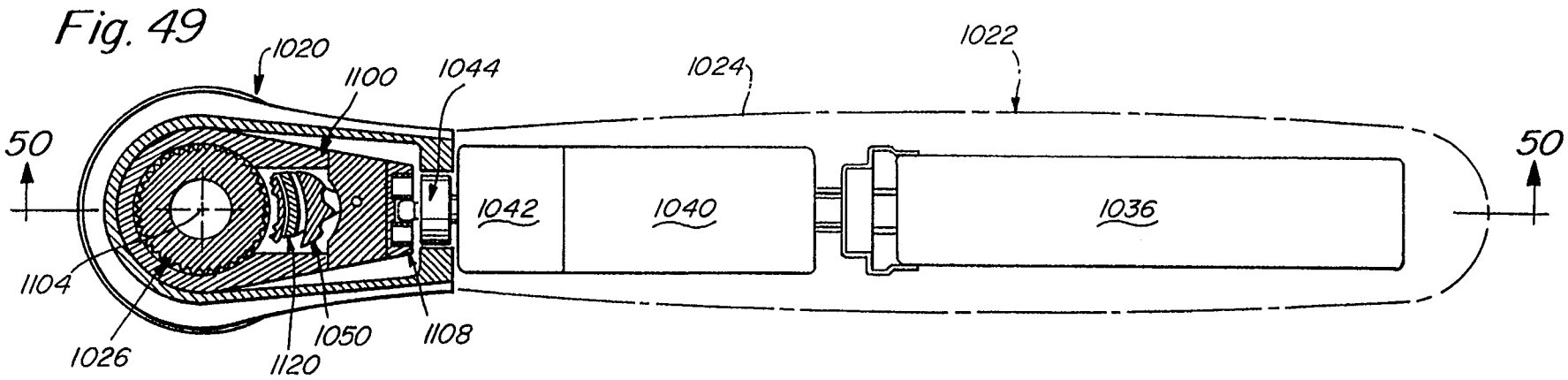
Figure 50:
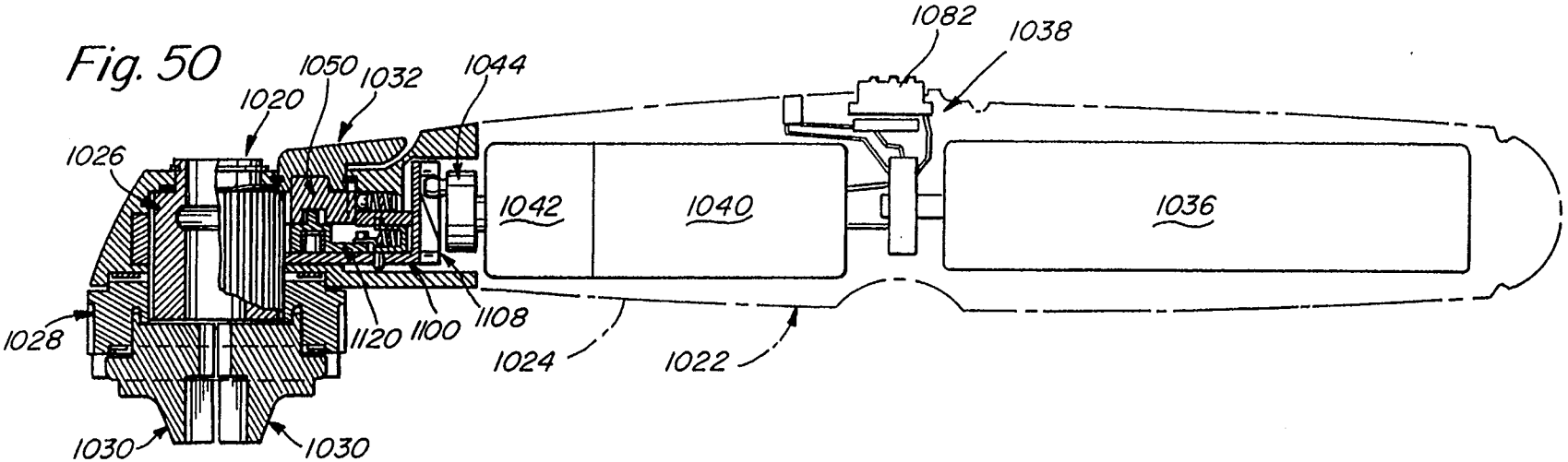
Figure 51:
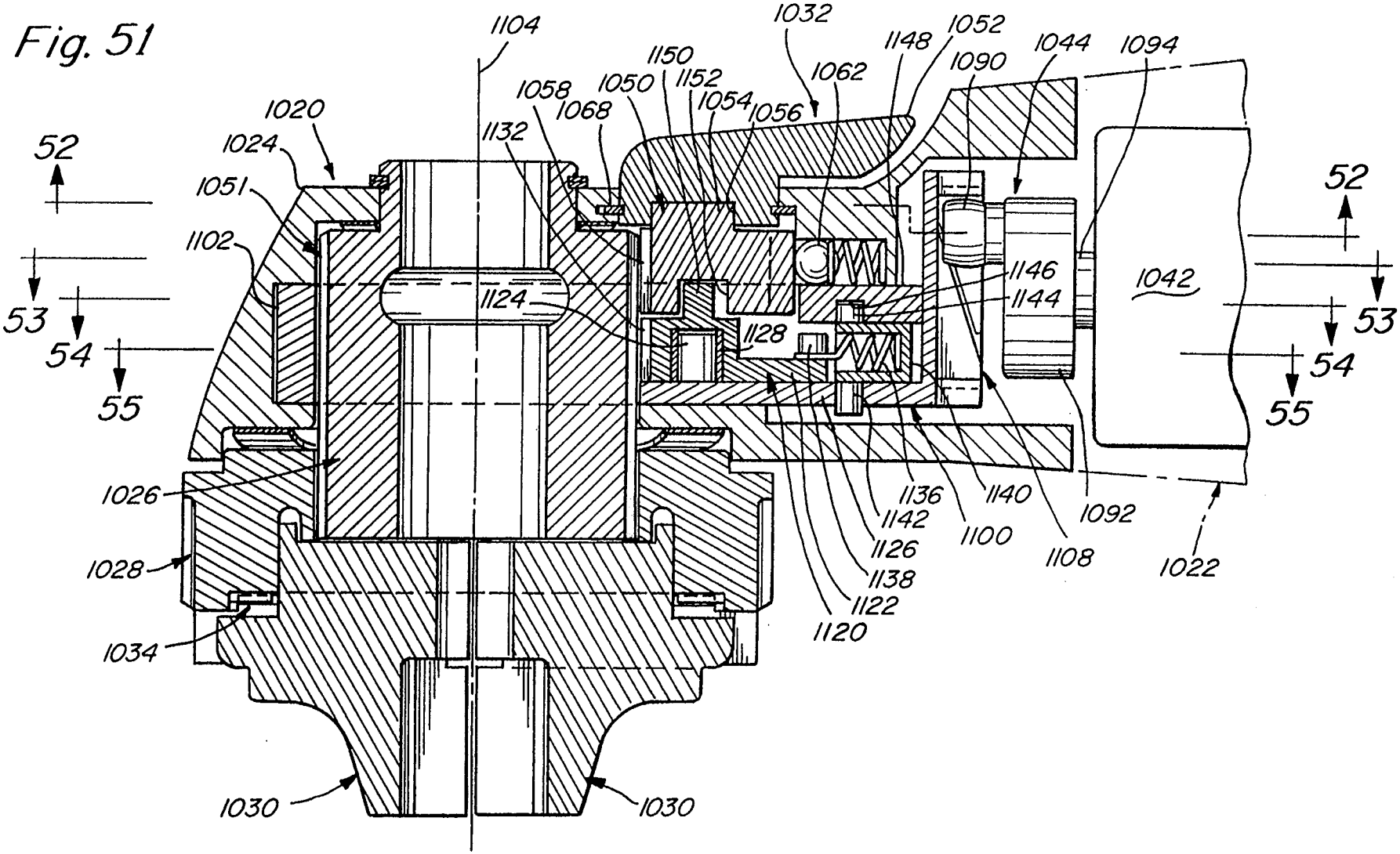
Figure 51A:
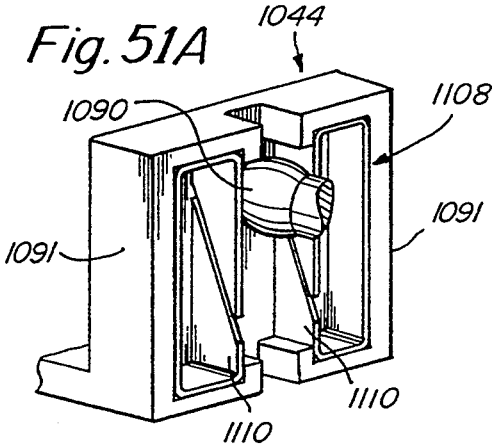
Figure 51B:
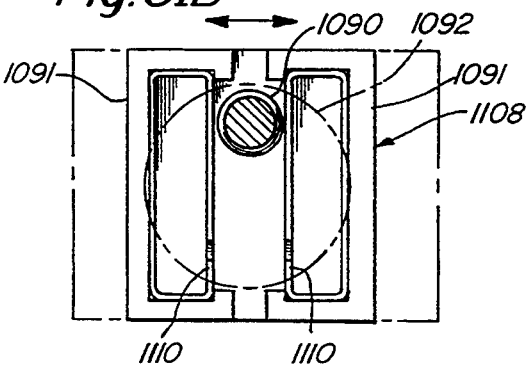
Figure 52:
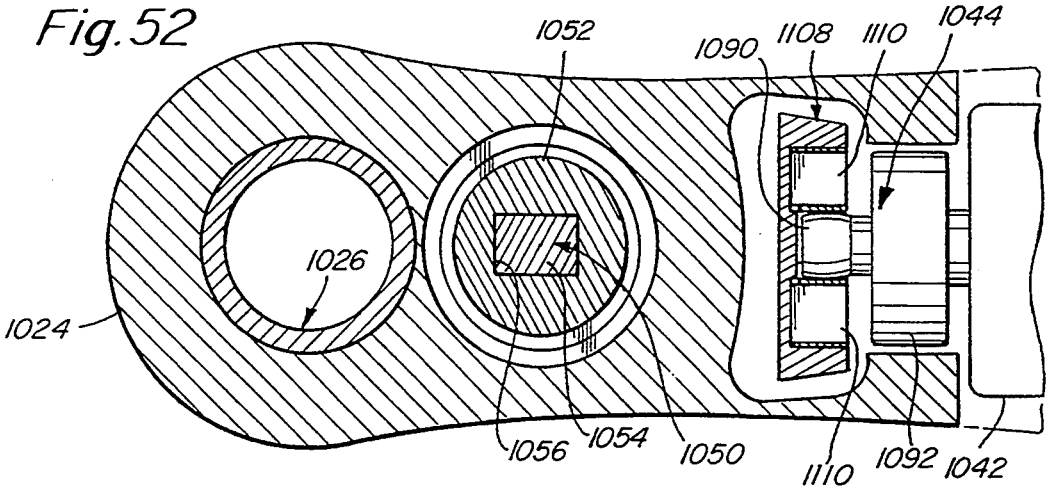

FIGS. 3 and 4 are horizontal cross-sectional views of the wrench taken along the section lines 3—3 and 4—4 in FIG. 2, respectively;

FIG. 5 is a cross-sectional view of another ratchet wrench embodying this invention and having a two-jaw system;

FIG. 6 is across-sectional view of the wrench shown in FIG. 5 taken along section line 6—6 in FIG. 5;

FIG. 7 is a fragmentary cross-sectional view of one form of a ratchet-type adjusting disk locking device that may be employed in any of the embodiment of this invention;

FIG. 8 is a fragmentary bottom plan view of a control disk and housing and particularly showing the ratchet gear that forms part of the locking device of FIG. 7;

FIGS. 9 and 10 are fragmentary cross-sectional views of a second form of locking device and showing the ratchet in the operative and inoperative positions, respectively;

FIGS. 11 and 12 are pictorial top and side views of a power driven adjustable ratchet wrench embodying this invention;

FIGS. 13 and 14 are diagrammatic top and side views of the wrench shown in FIGS, 11 and 12 with the casing of the wrench shown in broken lines;

FIG. 15 is a cross-sectional view of yet another embodiment of an adjustable wrench head particularly designed for use with a square drive;

FIG. 16 is a top plan view of the wrench head showing FIG. 15;

FIG. 17 is an exploded view of yet another embodiment of this invention;

FIG. 18 is a vertical cross-sectional view of a ratchet wrench according to another embodiment of this invention;

FIG. 19 is a vertical cross-sectional view of the wrench shown FIG. 18 taken along section line 19—19 of that figure;

FIG. 20 is a horizontal cross-sectional view of the wrench shown in FIG. 18 taken along section line 20—20 in that figure;

FIGS. 21, 22, 23 and 24 are horizontal cross-sectional views of the wrench taken along section lines 21—21 , 22—22, 23—23, and 24—24, respectively in FIG. 19;

FIG. 25 is a vertical cross-sectional view similar to FIG. 18, with the jaws in the fully closed position;

FIG. 26 is a vertical cross-sectional view taken along section line 26—26 in FIG. 25;

FIG. 27 is a horizontal cross-sectional view of the ratchet wrench embodying another locking device of this invention;

FIG. 28 is a vertical cross-sectional view of the ratchet wrench with yet another embodiment of locking device embodying this invention;

FIGS. 29 and 30 are vertical cross-sectional views of an improved locking device of the embodiment shown in FIG. 28 with the parts in operative and inoperative positions, respectively;

FIGS. 31 and 32 are top plan views of the system shown in FIGS. 29 and 30, respectively;

FIG. 33 is a vertical cross-sectional through the head of the preferred embodiment of manually operated adjustable ratchet wrench, constructed in accordance with this invention, with the jaw locking device shown in the open position enabling the laws to be opened by rotation of the adjusting disk;

FIG. 34 is a view similar to FIG. 33 but showing the locking device in the locked position so as to prevent opening of the jaws;

FIG. 35 is a vertical cross-sectional view of the head of the adjustable ratchet wrench shown in FIGS. 33 and 34 taken along section line 35—35 in FIG. 34;

FIG. 36 is a horizontal cross-sectional view of the head of the tool taken along section line 36—36 in FIG. 33;

FIG. 37 is a side elevation view of the head of the adjustable wrench shown in FIGS. 33–36 with a portion of the adjusting ring and control member broken away so as to expose the gears that form part of the lock assembly for the jaws;

FIG. 38 is a horizontal cross-sectional view of the head of the adjustable wrench, taken along section line 38—38 in FIG. 33;

FIG. 39 is horizontal cross-sectional view of the head of the adjustable ratchet wrench shown in FIGS. 33–38, taken long the section line 39—39 in FIG. 33;

FIG. 40 side elevation view of the head of an adjustable ratchet wrench similar to that of FIG. 37 but showing modification of the jaw locking device with its parts in the unlocked position;

FIG. 41 is a side elevation view of the embodiment shown in FIG. 40 but with the law locking assembly in the locked position;

FIGS. 42 and 43 are horizontal cross-sectional views of the head of the adjustable ratchet wrench shown in FIGS. 40 and 41, taken along the section lines 42—42 and 43—43 in FIG. 40, respectively;

FIG. 44 is a vertical cross-sectional view of the head of an adjustable ratchet wrench like that shown in the embodiment of FIGS. 33–39 but showing yet another modification of the jaw locking device;

FIG. 45 is a side elevation view of the head of the wrench of FIG. 44 with a portion of the adjusting disk and control member broken away to show the details of the jaw locking device in the open condition;

FIG. 46 horizontal cross-sectional view of the head of the wrench, taken along the section line 46—46 in FIG. 44;

FIG. 47 is a bottom view of the bracket in FIG. 44, which retains the latch or detent of the jaw locking device in the adjusting cam;

FIG. 48 is a fragmentary cross-sectional view taken along the section line 48—48 in FIG. 47;

FIG. 49 is a diagrammatic view of yet another embodiment of this invention which enables the ratchet wrench to be either manually or automatically powered;

FIG. 50 is vertical cross-sectional view of the tool taken along the section line 50—50 in FIG. 49;

FIG. 51 is an enlarged fragmentary cross-sectional view of the head end of the tool shown in FIGS. 49 and 50;

FIG. 51A is perspective view of the eccentric pin and slide connection for driving the head of the tool;

FIG. 51B is an elevation view of the eccentric pin and slide showing in broken lines the circular path of the eccentric pin and the translational oscillating motion of the slide;

FIGS. 52–55 are horizontal cross-sectional views taken along the section lines 52—52, 53—53, 54—54 and 55—55 FIG. 51; and FIGS. 56–59 are a series of a horizontal cross-sectional views showing a sequence of positions of the power drive assembly of the tool shown in FIGS. 49–55.

DETAILED DESCRIPTION

In the following description, this invention is described under appropriate headings as it is embodied in a variety of different tools. The first embodiment shows the invention incorporated into a ratchet wrench, and the entire tool is disclosed in detail. Many of the other embodiments are described only as they differ from the first embodiment.

Adjustable Ratchet Wrench

The adjustable wrench 10 shown in FIGS. 1–4 among it major components includes a housing 12 with an integral handle 14, three jaws 70 for gripping the workpiece (not shown) to be turned by the wrench 10, a control member or disk 28 disposed in the housing for guiding the radial movement of the jaws 70 as they are tightened on and release the workpiece, a rotatable adjusting disk 80 that engages the jaws to radially move them to engage and release the workpiece, and a reversing ratchet mechanism 16 that determines the direction of effective motion of the handle to turn the jaws. These components are described in detail below.

The housing 12 has a shallow chamber 20 open at the bottom as shown at 22. The housing 12 also has an opening 24 in the housing top wall 27. The openings 22 and 24 of the housing are coaxial with one another and with the axis 26 of the chamber 20.

The control disk 28, annular in shape with a central opening 30, is coaxially disposed in chamber 20. The disk 28 on its bottom surface 32 has three radial slots 34 as shown in FIG. 4 that extend from the central opening 30 of the disk to its periphery 36. The peripheral side wall of disk 28 above the slots 34 carries a circular gear 38 having vertically oriented teeth 40. The circular gear 38 is part of the ratchet mechanism 16 for keying the control disk 28 to the housing 12 and handle 14.

The ratchet mechanism 16 is shown in detail in FIGS. 2 and 4. The ratchet mechanism includes a pawl 46 disposed in a well 48 formed in the handle 14 at the region where the handle merges into the housing. The well is open at one side to the chamber 20 (see FIG. 4) so that each set of teeth 50 and 52 on the pawl may selectively engage the circular gear 38 on the control disk 28. The pawl 46 is retained in either of two positions wherein one or the other of the sets of teeth 50 and 52 engages the circular gear 38, by means of a ball detent 54 disposed in cavity 56 communicating with the well 48 and formed in the handle. As shown in FIG. 4, two notches 58 and 60 are formed in the side of the pawl 46 opposite the sets of teeth 50 and 52, and each notch is sized to receive the ball 62 of the detent 54. The ball 62 is biased to extend out of the cavity 56 by spring 64, which causes the ball to engage either notch 58 or 60 depending upon which registers with the cavity 56. If the ball detent 62 registers with the notch 60 in the pawl 46, it yieldably urges the set of teeth 52 in the pawl into engagement with the circular gear 38. When the pawl is turned from the position shown in that figure so that the ball 62 engages the other notch 58, the teeth 50, rather than the teeth 52 in the pawl will engage the circular gear 38. The lever 18 which may be readily gripped between the thumb and forefinger enables the person using the tool to change the working direction of rotation of the ratchet wrench. With the pawl 46 in the position shown in FIG. 4, counterclockwise rotation of the housing 12 and handle 14 about the axis 26 will cause the control disk 28 to rotate with the handle. However, when the handle is turned in the opposite direction (clockwise), the teeth 52 will ride over the teeth 40 of the circular gear 38 and will not turn the control disk 28 with the housing. When the position of the pawl 46 is altered so that the teeth 50 engage the circular gear, clockwise, rotation of the housing and handle will cause the control disk 28 to turn with it. However, counterclockwise rotation of the housing and handle will not do so.

In the embodiment of this invention shown in FIGS. 1–4, three jaws 70 having inner flat gripping faces 72 facing the axis 26 are disposed beneath the control disk 28, and each has a rib 74 along the top that extends into one of the slots 34 on the bottom surface of the control disk. The three jaws 70 are supported by the adjusting disk 80 disposed below the control disk 28 and that surrounds the waists 82 of the jaws. Each jaw has a flange 84 which engages the lower edge 86 of the adjusting disk 80 below the waist 82, and the upper ends of the jaws defined by the ribs 74 extend over the upper surface 88 of the disk 80. The jaws are prevented from falling off the inner face of the disk 80 by the fingers 90 that serve as cam followers in arcuate cam tracks 92 formed in the upper surface 88 of the adjusting disk 80 as is described more fully below and shown in FIG. 3.

The cam tracks 92 converge toward the axis 26 from their outer ends 94 to their inner ends 96 as they extend circumferentially in the plate 80 (see FIG. 3). Therefore, as the adjusting disk 80 rotates with respect to the housing 12, the cam tracks 92 urge the jaws either toward or away from the axis 26 because the cam followers 90 lie in the cam tracks 92, but the jaws will not turn with the adjusting disk 80 but rather are confined to radial movement because the ribs 74 lie in the radial slots 34 of the control disk 28.

A second set of cam surfaces 100 is provided on the inner edge of the adjusting disk 80, and the surfaces 100 engage the outer surfaces 93 of the waists 82 of the jaws 70. The surfaces 93 also serve as cams and compliment the cam surfaces 100. The cam surfaces 93 and 100 parallel the cam slots 92 and therefore cooperate with the cam slots to move the jaws inwardly as the adjusting disk 80 is turned counterclockwise as viewed in FIG. 3. The cam surfaces 100 not only serve to move the jaws inwardly in cooperation with the cam slots 92 under counterclockwise rotation of the adjusting disk 80, but further serve as the major load bearing walls of the wrench to support and stabilize the jaws against the outwardly directed forces applied to the jaws by a workpiece such as a bolt or nut engaged by jaw faces 72.

Figure 1:
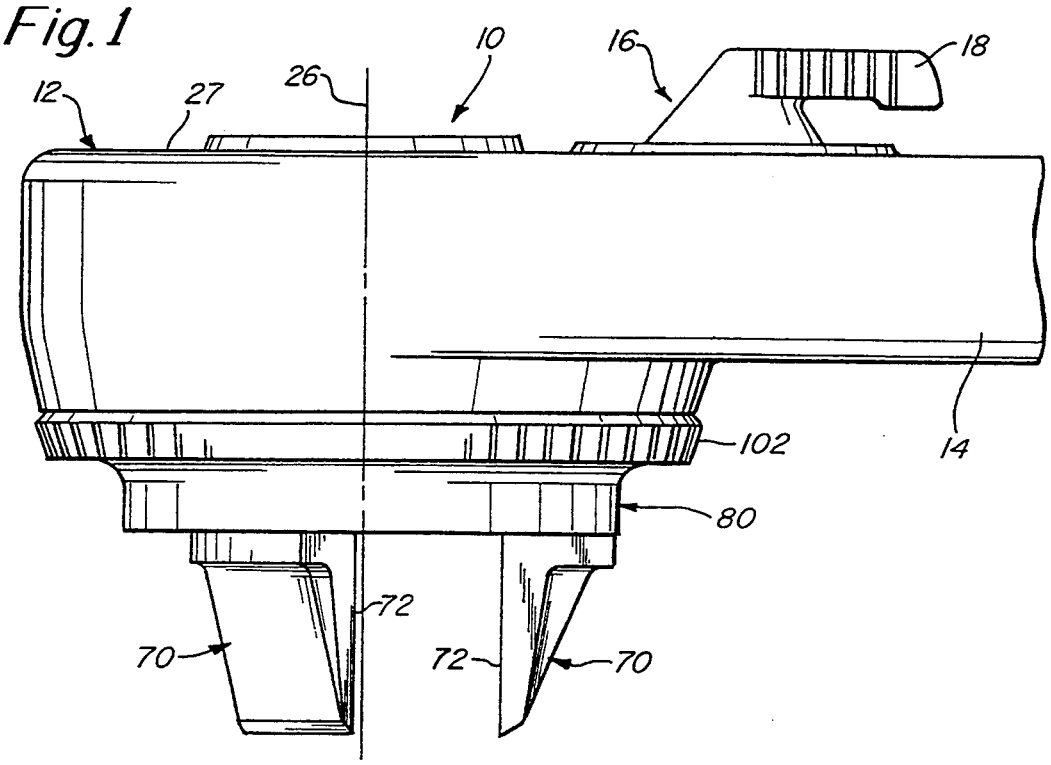
FIG. 1 is an enlarged view of a ratchet wrench having a three-jaw system embodying this invention and with the handle of the wrench broken away.

The adjusting disk 80 as shown in FIG. 1 has a ribbed collar 102 which is easily grasped by the user of the tool so that it may be readily turned to adjust the positions of the jaws 70.

The adjusting disk 80 is supported on the housing 12 by the retaining ring 164 that lies in the opposed annular recesses 106 and 108 formed in the housing 12 and adjusting disk 80, respectively. The retaining ring 104 holds the adjusting disk 80 in place while permitting free rotation of it. A similar retaining ring 110 retains pawl 16 in the well 48 by virtue of its registration with the opposed slots 112 and 114 in the collar 116 of the pawl and the upper wall 118 of the housing.

Two Jaw System

In the embodiment described above and shown in FIGS. 1–4, three jaws are provided in the tool, each having a flat gripping face 72 for engaging a workpiece. In FIGS. 5 and 6 a ratchet wrench having a two jaw system is shown. In the two jaw tool, the control disk, adjusting disk and ratchet mechanism all operate in the same fashion as the embodiment of FIGS. 1–4. However, because only two jaws are employed, the guiding slots in the control disk and the cams provided in the adjusting disk are modified, although essentially only in their number. In FIG. 5, the housing 200 is shown to contain the control disk 202 on the bottom surface of which are two opposed slots 204 aligned with one another and which receive the ribs 206 on the tops of the jaws 208.

Each of the jaws 208 has a V-shaped gripping face 210 composed of flat surfaces 212 and 214 that diverge from one another away from a shallow groove 216 at the line of intersection of the planes of the surfaces (see FIG. 6). The included angle between the surfaces is 120° so that each of the opposed jaws may engage two adjacent faces of a hexagonal nut, bolt or other workpiece. The grooves 216 at the intersections of the jaw surfaces will protect the corners of the hexagonal member engaged by the jaws from being scarred or rounded when a torque is applied by the jaws to the work.

It will be noted in FIG. 6 that two cam surfaces 220 are provide on adjusting disk 224, which engage the waists 226 of the jaws 208. The cam surfaces 220 engage the mating cam surfaces 232 on the waist of each jaw so that rotation of the adjusting disk 224 causes the jaws to move toward or away from the axis of the tool.

As in the first embodiment, downwardly extending fingers 236 are provided on the outer radial ends of the ribs 206 of the jaws, which extend into the cam tracks 238 in the upper surface of the adjusting disk 224. The cam tracks 238 parallel the cams 220 and 232 on the inner surface of the adjusting disk and outer surfaces of the waists of the jaws so as to maintain the jaws with their faces 210 parallel to the tool axis.

In this embodiment, a third cam system is provided to maintain the jaws in proper alignment. It will be noted in FIG. 5 that an upwardly extending finger 240 is formed in each of the jaws beneath the waist and parallel to the finger 236 on the rib 206, and each finger 240 extends into a cam track 242 formed in the lower surface 244 of the adjusting disk 224, which mirrors the cam track 238 on the top of the adjusting disk 224.

Ratchet for Adjusting Disk

In FIGS. 7–10, two different arrangements are shown for yieldably locking the adjusting disk 80 so as to prevent unintentional rotation of it, which would alter the position of the jaws. In the embodiment of FIGS. 7 and 8 the device is shown as it may be applied to the ratchet wrench of FIGS. 1–4.

In FIG. 8 an arcuate ratchet gear 120 is shown on the bottom surface of the control disk 28 between two of the slots 34 that receive and guide the ribs 74 of the jaws. The ratchet gear 120 is concentric with the axis 26 of the tool. In FIG. 7 a detent or catch 122 is shown disposed in a recess 124 in the adjusting disk 80, and the detent is urged upwardly by the spring 126 that surrounds the stem portion 128 of the detent. The detent has teeth 130 in its upper surface, which engage the ratchet gear 120 in the lower surface of the control disk 28. The pressure of the spring 126 urging the detent teeth 130 to engage the ratchet gear 120 is sufficient to prevent accidental turning of adjusting disk 80 relative to control disk 28, which could loosen the jaws 70. The detent and ratchet gear will also resist any tendency for the jaws to open in response to forces applied against their gripping faces by a workpiece engaged by the jaws. At the same time, the spring is flexible enough so that when the operator intentionally rotates the adjusting disk 80 by engaging the collar 102, the teeth 130 in the detent or catch will ride over the ratchet gear 120 so that the jaws may be moved when the tool is to be tightened on or loosened from the workpiece.

In FIGS. 9 and 10, a different catch arrangement is shown for locking the adjusting disk 80 against undesirable rotation which would loosen the jaws on the workpiece. In this embodiment a catch or detent 140 is disposed in a recess 142 in the adjusting disk 80. Like the detent 122, the detent 140 has a stem 144 surrounded in part by a coil spring 146. The detent 140 is guided for reciprocal motion in the recess 142 by the complimentary dimensions of the two in the regions of the head 143 and the stem 144 of the detent. A slot 148 is provided in the stem 144 which in turn receives the stem 150 of lock button 152. A pair of mating ramps 154 and 156 are provided in the stems 144 and 150, respectively, and the ramps cause the detent 140 to be withdrawn into the recess 142 when the lock button 152 is depressed as shown in FIG. 10. This action will cause the teeth 141 on the upper surface of the detent to disengage the ratchet gear 120 in the bottom surface of the control disk 28 so that the adjusting disk 80 may rotate freely to open the jaws. When the lock button 152 is released, the spring 146 will push the detent upwardly so that its teeth 141 will reengage the gear 120 and prevent the adjusting disk from rotating. At the same time the ramps 154 and 156 will cause the lock button to return to its extended position.

In FIGS. 9 and 10 the teeth 141 are shown to have a saw-tooth configuration, that is, one steep face and one ramp face. This arrangement prevents the detent 140 from moving over the ratchet teeth 141 in one direction, and thereby prevents the adjusting disk 80 from moving in that direction relative to the control disk 28 unless the lock button 152 is depressed. The adjusting disk 80 can, however, move in the opposite direction as the detent teeth will ride over the ramp faces of the ratchet teeth. Thus the embodiment of FIGS. 9 and 10 provides a positive lock to prevent the jaws from opening in response to the reactive force applied by the workpiece to them while permitting the jaws to be closed on the workpiece simply by turning the adjusting disk 80.

Power Driven Adjustable Ratchet Wrench

In U.S. Pat No. 5,090,273 one embodiment of the wrench is provided with a power handle for automatically driving the work engaged by it. The adjustable wrench of the present invention is also suitable for use with a power handle.

In the embodiment of FIGS. 11–14, an adjustable wrench is shown having a head 270 which is essentially the same as the head of the hand tool shown in FIGS. 5 and 6. The tool includes a control disk 272 having a circular gear 274 on its outer surface that is positioned to be engaged by the pawl 276 in the same manner as the pawl 16 of the ratchet mechanism shown in FIG. 4. Disposed beneath the circular gear 274 and within the housing 280 is a circular drive gear 278. The circular drive gear 278 may be integral with or rigidly fixed to the control disk 272 and does not turn independently of it.

Beneath the control disk 272 is an adjusting disk 282 provided with cam surfaces identical to those in the adjusting disk 224 of the embodiment of FIGS. 5 and 6. The adjusting disk 282 in turn supports a pair of V-shaped jaws 284 that move radially toward and away from one another in response to rotation of the adjusting disk 282. A pair of slots (not shown) in the lower surface of the control disk 272 contain the ribs (not shown) formed on the upper ends of the jaws to limit the travel of the jaws to a radial direction with respect to the control disk. This structure is the same as the structure described above in connection with the earlier embodiments and is not shown again.

A pair of beveled gears 290 and 292 that engage one another are disposed in handle 288 where it merges with the head 270. The beveled gears are driven by a DC motor 294 through a planetary gear reduction unit 296 all disposed in the handle, and the beveled gear 290 in turn has a circular gear 298 that engages the circular gear 278 attached to and forming part of the control disk 272.

The DC motor is driven by a rechargeable battery pack 300 also disposed in the handle, and the battery pack and DC motor are connected through a switch 302 which turns the motor on and off. The polarity of the motor is controlled through the switch 303 which in turn is manually controlled by the pawl lever 305. The pawl 276 and the direction of motor rotation are thus coordinated so that when the tool is operated manually after the resistance of the work to rotation overcomes the motor, the tool will be in condition for this change simply by shutting off switch 302 as is more fully explained below.

As in the other embodiments of this invention, the position of the jaws is controlled by the adjusting disk 282. When that disk is turned in one direction, the jaws will close upon any work disposed between them, and when the disk 282 is rotated in the opposite direction, the jaws open, all under the influence of the cams in the disk 282 acting on the mating cam surfaces provided in the jaws.

The power driven tool of FIGS. 11–14 may be operated either manually or automatically by the power system contained in the handle. If the tool is to be operated manually, the power switch 302 is placed in the off position and the position of pawl 276 is set by means of the pawl lever 305 to select the rotational driving direction of the tool. The jaws are opened and closed by rotation of the adjusting disk 282. When the wrench is to be automatically powered, the motor is turned on by switch 302, which will cause the beveled gears to continuously rotate the circular drive gear and control disk 272 and turn the jaws and work engaged by them. By reversing the polarity of the motor 294 by means of the switch 303 controlled by the pawl lever 305, the work may be rotated in the opposite direction. When the task is completed, the jaws may simply be opened by rotating the adjusting disk 282 in the manner described above.

The torque which the power handle is capable of exerting on the work through the jaws is limited, and to tighten the workpiece it normally is necessary to complete the task by turning the wrench manually. Typically, the power handle will very rapidly drive a nut down a threaded stud until it engages the surface against which it is to be tightened, and at that point the operator will shut off the motor by throwing the switch 302. The pawl will be set in the proper position, as described above, due to its use in setting the switch 305, so that manual operation may proceed without further adjustment of the tool. The tool may be used in the manual mode as a conventional ratchet wrench.

Adjustable Wrench Head With Square Drive

The adjustable wrench head shown in FIGS. 15 and 16 is a modification of the head shown in FIGS. 5 and 6. The modified head is designed to be driven by a variety of square drive products. In this embodiment, the ratchet is eliminated and the control disk serves not only as the control for the jaws but, in addition, serves as the means for connecting the head to the square drive. As shown in FIG. 15, the adjusting head 330 has a bell-shaped control disk 332 having an axially extending square recess 334 sized to receive standard square drive products such as handles with standard ratchet square drives, standard square drive extension bars etc. In this embodiment, a pair of V-shaped jaws 336 are carried by the control disk 332 by means of the adjusting disk 338 which is connected to the control disk 332 by the retaining ring 340.

The jaws 336 may be identical to those shown in the embodiments of FIGS. 5 and 6, and the adjusting disk 338 may also be identical to the adjusting disk of that embodiment. Thus, cam surfaces 342 are provided on the outside of the waist 344 of the jaws, which in turn mate with the cam surfaces 346 in the adjusting disk 338. In addition, upwardly and downwardly extending fingers 348 and 350, respectively are disposed in cam slots in the lower and upper surfaces 352 and 354 of the adjusting disk to stabilize the jaws.

A downwardly open radial slot 356 is provided in the control disk 332, which receives the ribs 358 on the jaws to confine their motion to a radial direction with respect to the control disk 332 as the adjusting disk 338 is turned. It will be appreciated that when the adjusting disk is turned by engagement of the ribbed collar 360, the jaws 336 will move radially inwardly or outwardly with respect to the head axis 362 because of the restriction imposed on their motion by the slot 356 in the control disk 332 which engages the jaws.

It will be appreciated that the wrench head shown in this embodiment may be engaged by any square drive so as to rotate the jaws to turn the work engaged by them. The entire assembly shown in FIG. 15 will rotate together with the square drive, and the jaws may be opened or closed on the work merely by turning the adjusting disk.

Adjustable Wrench Modular System

In FIG. 17, an exploded view of yet another embodiment of this invention is shown. It includes all the parts of the adjustable wrench shown in FIGS. 1–4 (or FIGS. 5 and 6, depending upon the number of jaws desired) plus three additional parts as described in detail below, and it will selectively function as either an extension wrench similar to the extension wrench in co-pending application Ser. No. 07/392,206 or as an adjustable ratchet wrench as in the embodiments of FIGS. 1–4 and 5–6.

This embodiment will best be appreciated with reference to FIGS. 1 and 2 as well as the exploded view of FIG. 17. The major elements of the system are the ratchet housing 12 with handle 14, which includes the control disk 28, collectively identified by reference 400; modular drive 402, extension member 404; modular cover 406; and wrench head 408 which is identical to and includes the adjusting disk 80 and jaws 70 of the embodiment of FIG. 5. It will be appreciated that by removing the retaining ring 104 (see FIG. 2), thee housing 12 and control disk 28 may be separated from adjusting disk 80 and jaws 70 to provide the top and bottom components of the array of parts shown in FIG. 17.

The modular drive 402 includes circular body 412 with three ribs 414 and a retaining ring slot 416 that fit into the open bottom of the housing 12 in place of the removed adjusting disk and may be retained in the housing by the retaining ring 104. In that position, the ribs 414 key the drive module to the control disk 28. The drive module also has a hexagonal shaft 417 that depends from the body 412.

The module cover 406 is very similar to the combination control disk and cover 332 in the embodiment of FIG. 15. However, it has a hexagonal shaft 420 that extends coaxially upwardly at its top. Just like the disk and cover 332, it includes a slot (not shown) at the bottom to receive the ribs (not shown) on top of the jaws and a retaining ring slot to match the slot in the adjusting ring to receive a retaining ring to keep the two assembled together.

The extension member 404 has open hexagonal sockets 422 and 424 to receive the shafts 417 and 420 on the module drive 402 and the module cover 406, respectively, to join all the parts of the modular extension wrench together. It will be noted that all the parts of the assembly have open centers. Consequently, the workpiece engaged by the jaws can be threaded down upon an elongated bolt or stud without interference. The tool can be operated as a conventional extension wrench, and the ratchet handle and housing provide convenient manual operation. Furthermore, the readily adjustable jaws allow the tool to be used both as an extension wrench and ratchet wrench on a wide variety of metric and standard sizes of nuts, bolts and other workpieces.

It will be evident that the embodiments of the adjustable wrench described above are very easy and convenient to use and provide a tool that can be used for a variety of purposes and can accommodate the most popular sized nuts and bolts from a range of 5/16th inch to 1 inch as well as all the metric and standard sizes within that range. It will also be appreciated that because in all of the above described embodiments with the exception of the square drives of FIGS. 15 and 16, the tools are open at the center above the jaws, the threaded portion of a bolt or stud onto which a nut is being turned may extend through or into the tool so as to provide the same versatility as a deep bolt socket wrench.

The tool in each of its forms is very easy and convenient to operate because the jaws, whether they be 2, 3 or any other number, may be simultaneously adjusted by the adjusting disk. Furthermore, the simple control provided at the top in the form of the pawl handle allows the user to readily change the pawl setting so that the tool may drive the workpiece in a clockwise or counterclockwise direction as desired. Regardless of the setting of the ratchet, the jaws may be easily opened or closed by rotating the adjusting disk. The jaw locking device in either of the forms shown in FIGS. 7–10 may be incorporated into any of the tools to assure that the jaws will not be forced open under the influence of reactive forces applied to them by the workpiece when torque is applied.

The open center configuration of the ratchet wrench embodiment of FIGS. 1–44 and 5–6 allows the tool to be used very effectively with many different accessories. For example, the device may be used in combination with a screwdriver having a rotatable handle with the shaft extending through the open center of the tool. In a similar fashion, an automobile lug wrench may be used with the handle extending through the center of the tool.

Improved Two-Jaw System

In FIGS. 18–26, a two-jaw system is illustrated differing in several ways from the two-jaw system in FIGS. 5 and 6. The configurations of control member 520, adjusting disk 590 and jaws 570 of the two-jaw system shown in FIGS. 18–26 are different from the corresponding elements in the earlier two-jaw system.

The adjustable ratchet wrench 500 shown in FIGS. 18–26 includes a housing 502 having a handle 504 extending radially outwardly from the housing. A ratchet mechanism 506 provided on the top of the handle 504 has an operating lever 508 located at the point where the handle and housing merge.

The housing 502 has a chamber 510 with an open bottom 512. The chamber top wall 515 also has an axial opening 514. Open bottom 512, chamber 510 and upper opening 514 are concentric about axis 518. A concentric inner annular shoulder 516 is provided below the upper opening 514, and the diameter of the opening formed by the shoulder 516 is less than the diameter of opening 514.

The control member 520 which corresponds to the control disk 28 in the embodiment of FIGS. 1–4 has a central opening 522 and is coaxially disposed in the chamber 510. As shown in FIGS. 18–20, the control member 520 has an upper portion **520*a* which extends through the shoulder 516 of the housing 502. The lower portion 520*b* of the member 520 having a greater diameter than the first portion 520*a*, has a circular gear 530 formed on its outer surface. The circular gear 530 has vertically oriented teeth 532, and is part of the ratchet mechanism 506 for keying the control member 520 to the housing 502 and handle 504**.

The ratchet mechanism 506 which is shown in FIGS. 18 and 20 is essentially the same as the mechanism 16 of FIGS. 1–4. The mechanism 506 includes a pawl 550 which is located in a well 552 formed in the handle 504. The well opens to the chamber 510 so that two sets of teeth 554 and 556 on the pawl can selectively engage the circular gear 530 on the control component 520. The pawl 550 is retained in either of its two positions wherein either teeth 554 or teeth 556 engage the circular gear 530 by means of a ball detent 557 which is located in a cavity 558 in the side wall of well 552. As shown in FIG. 20, two notches 560 and 562 are formed in the side of the pawl 550 opposite the teeth 554 and 556, so as to receive the ball 564 of the ball detent 557. A spring 566 biases the ball 564 into engagement with either of the notches 560 and 562. By this arrangement, the ratchet mechanism operates in the same manner as the ratchet mechanism shown in FIGS. 1–4 and described previously.

Figure 22:
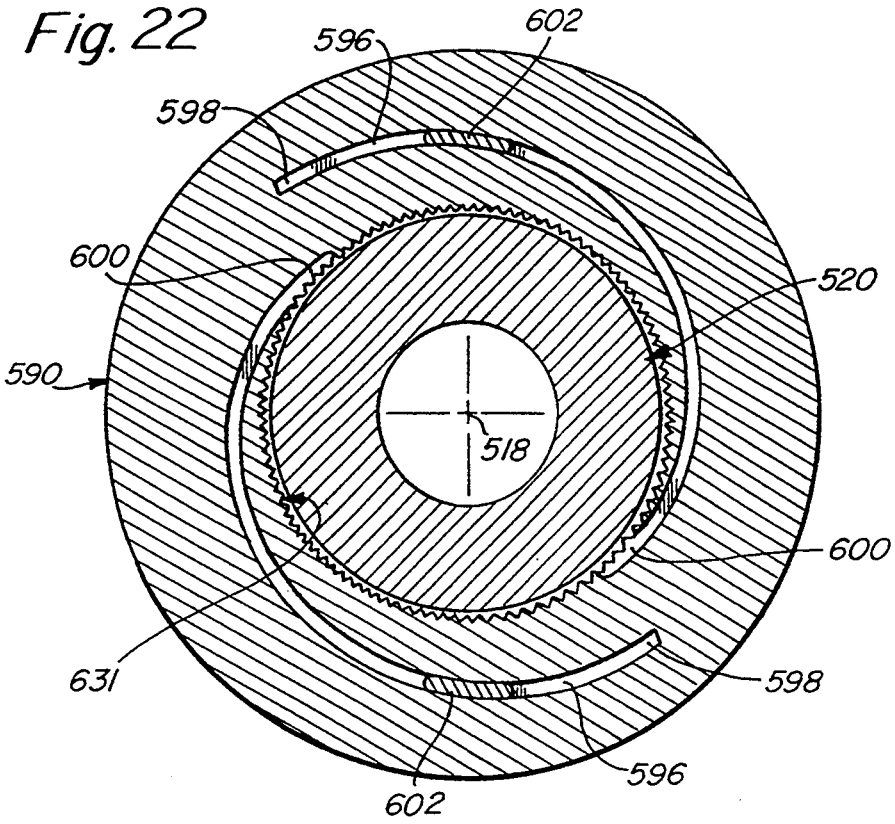

The jaws 570 in this embodiment are different from the jaws shown in the previous embodiments. In particular, as shown in FIGS. 18 and 22, cam followers 602 extend upwardly from the tops of the jaws 570 to engage the adjusting disk 590. The disk 590 is described in detail below. In the embodiment of FIG. 1–4, cam followers 90 extend downwardly to engage slots 92 in the adjusting disk 80. The two jaws 570 have inner flat gripping faces 572 facing axis 518.

Figure 23:
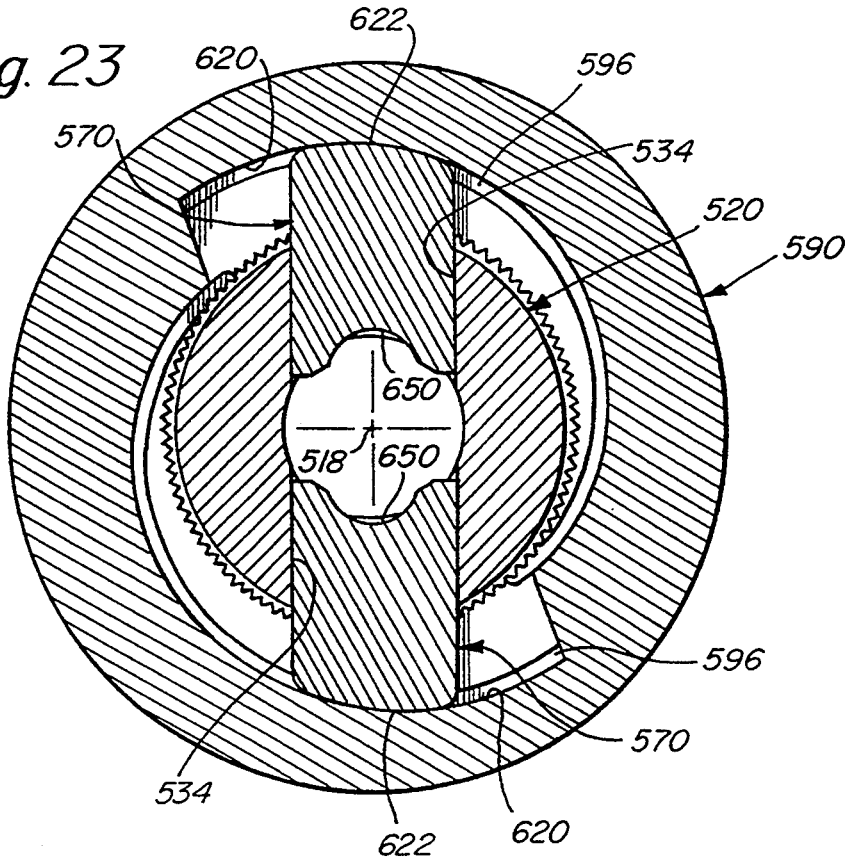

As shown in FIG. 23, the control member 520 has a pair of radially oriented slots 534 which are aligned with one another. Each slot is defined in part by a pair of shoulders 536 which extend inwardly to give the slots 534 a T-shaped cross-section (see FIG. 26). The control member 520 has a base flange 538 that extends radially, outward away from the axis 518 as shown in FIGS. 19 and 26. A vertical annular flange 540 extends upwardly from the outer edge of the flange 538.

Each jaw 570 has a rib 574 that extends into one of the slots 534 of the control member 520. A pair of flanges 576 project transversely from the top of each rib 574 perpendicular to the axis 518 to retain each of the jaws 570 in the T-shaped slots 534 of the control member 520. Each jaw has a flange 578 which engages the lower surface 592 of the control member 520 below the rib 574.

As shown in FIGS. 19, 25 and 26 adjusting disk 590 has an annular flange 591 which extends inwardly toward the axis 518. A pair of arcuate cam tracks 596 are formed in the bottom surface 595 of the flange 591. The cam followers 602 project upwardly from the jaws 570 into the arcuate cam tracks 596, as shown in FIGS. 18, 22, and 25. The cam tracks 596 converge toward the axis 518 from their outer ends 598 to their inner ends 600 as they extend circumferentially in the bottom 595 of the flange 591 of adjusting disk 590. Therefore, as the adjusting disk 590 rotates with respect to the control member 520, the cam tracks 596 urge the jaws either toward or away from the axis 518 because the cam followers 602 lie in the cam tracks 596, but the jaws will not turn with the adjusting disk 590. They are confined to radial movement because the ribs 574 and flanges 576 lie in the radial slots 534 of the control member 520.

Figure 24:
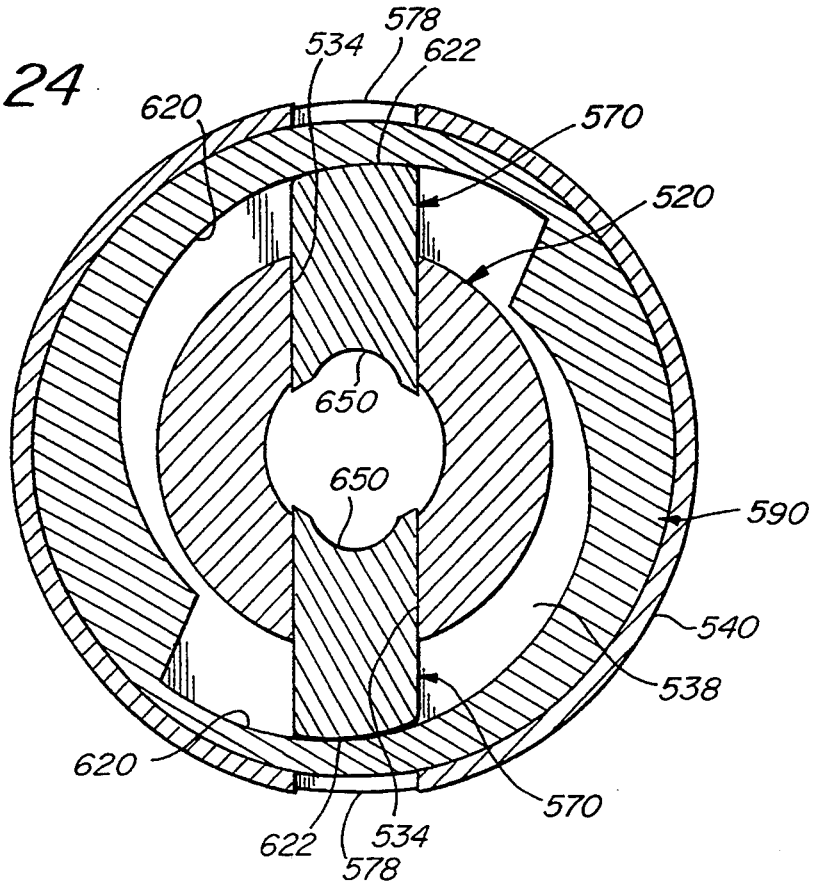

A second set of cam surfaces 620 are provided on the inner surface of the adjusting disk 590, as shown in FIGS. 23 and 24, and cam surfaces 620 engage the outer surfaces 622 of the jaws 570. The cam surfaces 620 and 622 parallel the cam tracks 596, as is clearly shown in FIG. 23, and therefore cooperate with the cam tracks to move the jaws inwardly as the adjusting disk 590 is turned counterclockwise as viewed in FIG. 23. The cam surfaces 620 not only serve to move the jaws inwardly in cooperation with the cam tracks 596 under appropriate rotation of the adjusting disk 590, but also act as the major load bearing walls of the wrench to support and stabilize the jaws against the outwardly directed forces applied to the jaws by workpieces such as a bolt or a nut engaged by the jaw faces 572.

As shown in FIG. 19, the upper surface 594 of the adjusting disk 590 engages the bottom 512 of the housing 502, and the lower surface 595 of the disk 590 rests on top of and is supported by the base flange 538 of the control member 520. The annular flange 540 on base 538 maintains the coaxial relationship of the adjusting disk 590 and control member 520.

The control member 520 is retained in the housing 502 by a retaining ring 606 which rests on top of inner shoulder 516 of the housing 502 as best shown in FIG. 19. The ring 606 lies in an annular recess 608 formed in the outer surface of the upper end portion 524 of the control member 520. Retaining ring 606 does not impede rotation of the member 520 relative to the housing 502. A similar retaining ring 610 retains pawl 550 in the well 552 of housing 502 by virtue of its registration with the opposed slots 612 and 614 in the pawl and upper wall 515 of the housing, respectively.

Figure 21:
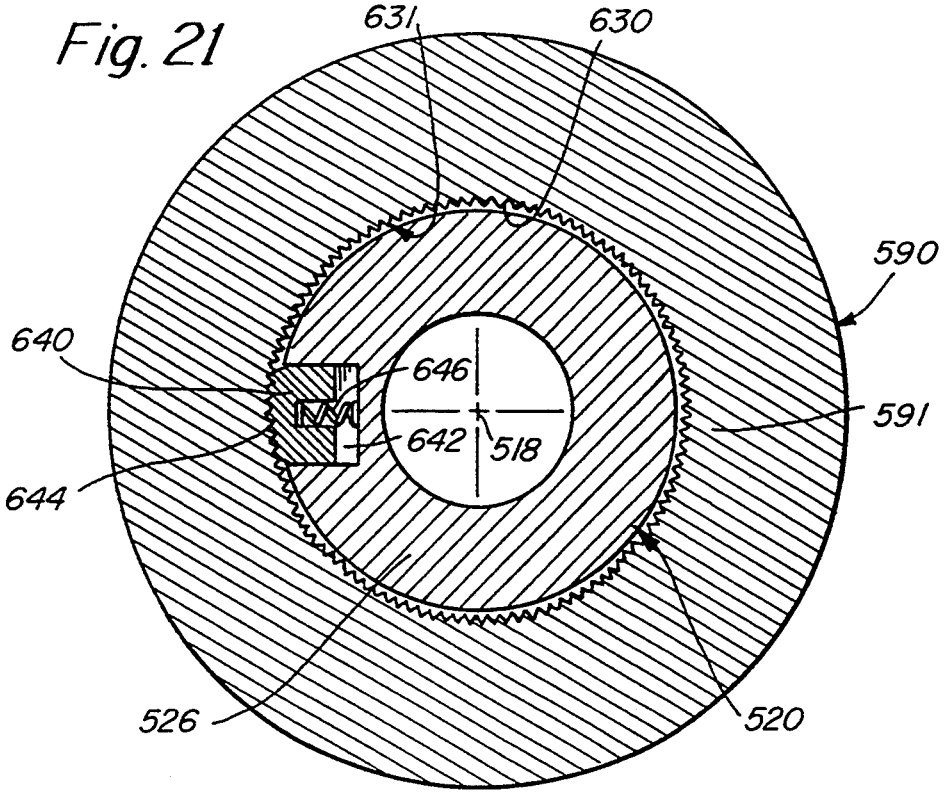

Unintentional rotation of the adjusting disk 590 is prevented by the locking arrangement shown in FIGS. 19 and 21. The inner surface of annular flange 591 of the adjusting disk 590 carries a series of vertically oriented teeth 630 that define a circular gear 631. A catch in the form of a detent 640 is provided in a recess 642 in the larger diameter portion 526 of the control member 520. The detent 640 has a series of vertically oriented teeth 644 which mate with the teeth 630 of gear 631 on the adjusting disk 590. The detent 640 is urged radially outward by a spring 646 located in the recess 642 behind the detent. The force of the spring 646 urging the detent teeth into engagement with the gear 631 is sufficient to prevent accidental turning of disk 590, that would open the jaws 570. The spring 646 is however sufficiently flexible so that when the operator intentionally rotates the adjusting disk 590, the teeth 644 on the detent will ride over the teeth 630 of gear 631 so as to enable the jaws to be intentionally opened and closed.

Jaws 570 above their gripping surfaces 572 have arcuate recesses 650 facing the axis 518 as shown in FIGS. 23 and 24. When the jaws are at their innermost position, the recesses 650 allow a bolt to extend up between the two jaws, thus enabling the wrench to grip a nut on a long threaded bolt.

Alternate Detent for Preventing Accidental Rotation of Adjusting Disk

In FIG. 27, a cross-section of the head of an adjustable ratchet wrench is shown, similar to the wrench of FIGS. 18–26. It differs from that embodiment in the means for locking the adjusting disk to prevent unintentional disk rotation which would alter the position of the jaws. FIG. 27 corresponds to FIG. 21 of the previous embodiment.

In this embodiment, three detents 700 are disposed in separate recesses 702 disposed 120° apart in the adjusting disk **590*a*. The detents 700 are each biased by a wave spring 708 to engage teeth 704 of the circular gear 631*a* on the outer surface of the cylindrical wall of control member 520*a***.

The detents 700 lock the adjusting disk **590*a* against undesirable rotation which would loosen the jaws on the workpiece. The springs 708 are flexible enough so that when the operator intentionally rotates the adjusting disk 590*a* by engaging its collar, the teeth of the detents 700 ride over the teeth on the control member 520*a* to enable the jaws to be moved when the tool is to be tightened on or loosened from a workpiece engaged by the jaws 570**.

Improved Locking Mechanism for Jaws of Adjustable Ratchet Wrench

In FIGS. 28–32, an improved locking mechanism for the adjustable ratchet wrench is illustrated. The mechanism is different from the detent-type mechanisms shown in FIGS. 7, 9, 10, 19, 21, and 27. In this embodiment, the adjustable wrench has a head which functions in essentially the same manner as the head of the tool shown in FIGS. 18–26. The tool includes a housing 502 with a handle 504 extending radially outward therefrom. A control member 520*b* provided in the shallow chamber in the housing, has a central passage 521*b* which is coaxial with the axis 518 of the housing. An adjusting disk 822 surrounds the control member 520*b*, and the jaws 570 extend downwardly away from the control member 520*b* and adjusting disk.

The ratchet mechanism for keying the control member 520*b* to the housing 502 and handle 504 operates in the same manner as in the embodiment of FIGS. 18–26. However, the locking mechanism for preventing unintended rotation of the adjusting disk which would loosen the jaws on the workpiece is significantly different.

As shown in FIG. 28, a plunger 800 extends through openings 801 and 803 in reversing pawl lever 805 and reversing pawl 807, respectively. The pawl and lever are separate pieces keyed together by the collar and socket 809 as shown in FIG. 28. (They have other than round horizontal cross-sections.) The plunger 800 does not interfere with the operation of the lever 805 and the pawl 807 for keying the control member 520*b* to the housing 502 and handle 504. When the plunger 800 is depressed, it pushes downwardly on a pressure ring stem 802, shown in FIGS. 28–30. Downward movement of the stem 802 is in turn transferred to the body of a pressure ring 804 that encircles the control member 520*b*. Referring to FIGS. 29 and 30, pressure ring 804 has fulcrum pivots 806 (only one shown) that extend downwardly from the lower face of pressure ring 804, 180° apart and displaced 90° from the stem 802. Consequently, when the stem 802 is depressed the side of ring 804 opposite the stem (the left side as viewed in FIGS. 29 and 30) rises and presses against the bottom 512 of the housing 502, as suggested in FIG. 30. The pivots 806 are supported on a distribution ring 808 which also encircles the control member 520*b*, below the pressure ring 804. Thus, downward force applied to the plunger 800 is transferred from the pressure ring 804 to the distribution ring 808 through the pivots 806. Distribution ring 808 carries inwardly extending cam pusher 810 as shown in FIGS. 31 and 32.

A semi-circular detent bracket 814 is positioned below the distribution ring 808 and is movable radially toward and away from the head axis 518 between the positions shown in FIGS. 31 and 32. The bracket 814 carries a detent 816 intermediate its ends, having teeth 818 of saw tooth configuration that face similar teeth 820 on the gear 821 on the periphery of control member 520*b*.

Each end of the bracket 814 has a cam 813 with an inclined upwardly facing ramp 812 that engages one of the cam pushers 810 on the distribution ring 808. A pair of upstanding posts 826 are also carried by the bracket 814, one adjacent each end, and a coil spring 824 has its ends 825 connected to the posts. The spring 824 along with a portion of the circumference of pressure ring 804 and distribution ring 808 all lie in a recess 830 in the top of adjusting ring 822 and defined in part by the arcuate wall 832, as clearly shown in FIGS. 28, 31 and 32.

The spring 824 pulling on the pins 826 on the detent bracket 814, biases the detent teeth 818 into engagement with the gear teeth 820 on the outside of the control member 520*b*. In the biased position, the configuration of the teeth with steep ramps on one side prevent the adjusting disk 820 from turning counterclockwise as viewed in FIGS. 31 and 32. However, counterclockwise rotation of the adjusting disk 820 is permitted when the detent disengages the control member 520*b*, which is accomplished by depressing the plunger 800 that extends above the pawl lever 805 on the handle. The plunger, in turn depresses the stem 802 which causes the pivots 806 on the pressure ring 804 to drive down the distribution ring 808 to act on the cam ramps 812 to move the detent bracket to the right (to the position of FIGS. 30 and 32) and the detent 816 disengages the control member 520*b*. A wave spring 828 beneath the distribution ring 808 urges that ring 808 and the pressure ring 804 to the raised position of FIG. 29, which causes the pushers 810 to release the cam ramps 812 and allow the coil spring 824 to return the detent bracket 814 to the position of FIG. 31 with the detent teeth interengaged.

The configuration of the ratchet teeth 818 and 820 of gear 821 on the detent and control member enable the user to turn the adjusting disk 822 clockwise as viewed in FIGS. 31 and 32 to tighten the jaws because the teeth 818 will ride up the shallow sides of the teeth 820. Thus, with the detent 816 in the locking position of FIG. 31 the jaws may be tightened on the workpiece. However, when the jaws engage the work, the detent 816 locks the adjusting disk against counterclockwise rotation and the jaws may not be opened without depressing the plunger 800.

Preferred Embodiment of Manual Adjustable Ratchet Wrench

In FIGS. 33–39 the preferred embodiment of the manually operated, two jaw, adjustable ratchet wrench is shown. The major parts are functionally the same as the corresponding parts in the embodiments of FIGS. 18–26 and 28–32 and little additional description is required. The tool of this embodiment a includes a head having a housing 900 with a handle 901, control member 902, adjusting disk 904, jaws 906 and ratchet assembly 908 for selecting the direction of drive of the handle on the head. These parts perform in the same manner as the corresponding parts of the tool of FIGS. 28–32. The locking mechanism for preventing the jaws from being forced or otherwise unintentionally opened, however, is different from the mechanism in that embodiment.

In this embodiment retaining rings 910 and 912 respectively, retain the control member 902 and ratchet assembly 908 in the housing 900. The adjusting disk 904 has inwardly facing cam surfaces 914 that bear against the mating outside surfaces 916 of the jaws 906 to push them toward the tool axis 918 when the disk 904 is turned clockwise as is apparent from an inspection of FIG. 36. The jaws 906 are retained in the assembly and confined to radial motion with respect to the control member 902 by means of the T-shaped guide slots 920 in the bottom of the control member 902 and the cooperating T-shaped ribs 922 on the tops of the jaws, as shown in FIG. 35 and described in detail in connection with FIG. 26. The jaws are opened by counterclockwise rotation of the adjusting disk 904 by virtue of the registration of the cam followers 924 carried by the jaws 906 with the cam tracks 926 in the adjusting disk, which parallel the cam surfaces 914 and 916.

The locking mechanism for preventing unintentional spreading of the jaws includes a circular gear 930 provided in the upper surface 932 of the lower circular flange 934 of the control member 902 and a mating pair of arcuate gear segments 940 on the bottom of the control disk 904 (see FIGS. 33 and 37). As shown in FIG. 37, the teeth of the circular gear and gear segments are saw tooth in shape having one essentially vertical side and one inclined side defining each tooth. It is evident in FIG. 37 that when the teeth are engaged as shown, the adjusting disk 904 cannot be turned counterclockwise (to the right) because the mating sides of the opposed teeth abutting one another are essentially vertical and, therefore, the adjusting disk 904 cannot ride over the teeth of the circular gear 930. Because counterclockwise rotation of the adjusting disk is required to open the jaws, the jaws cannot be opened unless the adjusting disk is raised so as to disengage the gear segments 940 from the circular gear 930.

In FIG. 33 a wave spring 944 is shown disposed between the upper surface 946 of the adjusting disk 904 and the lower surface 948 of housing 900. The wave spring 944 urges the adjusting disk downwardly toward the flange 934 of the control member 902 so as to cause the teeth of the arcuate gear segments to engage the teeth of the circular gear. In that position, the operator can rotate the adjusting disk 904 in a clockwise direction as the inclined surfaces of the respective gears will cause the gear segments to ride up and over the opposed teeth. The wave spring 944 is not so stiff as to prevent the operator from turning the adjusting disk with his fingers, as the spring 944 will allow the adjusting disk to move up and down the small distance required to enable the teeth of the gear segments to step over the circular gear teeth. As clearly shown in FIG. 33, a dirt barrier 950 in the form of a collar extends downwardly from the periphery of the housing 900 and closes the chamber occupied by the wave spring 944 between the surfaces 946 and 948.

A second wave spring 952 is disposed between the surface 954 of flange 956 of housing 900 and the upper surface 958 of the control member 902. Wave spring 952 urges the control member in a downward direction relative to housing 900 so as to yieldably hold the circular gear 930 carried on the lower flange 934 of the control member in a lowermost position. This assures that maximum space is provided for vertical movement of the adjusting disk 904 so that the teeth of the gear segments 940 and of the circular gear 930 can be disengaged so as to open the jaws 906 when desired.

A second dirt barrier 960 in the form of a circular collar is provided on the bottom of the adjusting disk 904 radially beyond the gear segments 940. The dirt barrier 960 prevents foreign matter from collecting between the gear segments 940 and the circular gear 930 on the control member flange 934, which could interfere with the proper operation of the locking assembly for the jaws.

The ratchet wrench of this embodiment operates in the same fashion as the previously described embodiments. In order to close the jaws 906 on the work piece, the adjusting disk 904 is turned clockwise which causes the cam surfaces on the adjusting disk to bear against the mating surfaces on the jaws and move them inwardly in a radial direction along a path defined by the T-shaped slots in the control member. The adjusting disk may be turned readily as the ramp configuration of the teeth on the gear segments and circular gear allow the control disk to rotate as it moves up and down as permitted by the wave spring 944. After the work is performed, the jaws may be opened simply by lifting the adjusting disk 904 to disengage the teeth of the gear segments from the circular gear and particularly the mating vertical faces of the gear teeth so that the disk may be turned counterclockwise. The cam tracks 926 will cause the cam followers 924 to draw the jaws 906 apart.

Modified Jaw Locking Assembly for the Embodiment of FIGS. 33–39

The modification shown in FIGS. 40–43 has a rotatable cam ring to release the gear segments on the adjusting disk from the circular gear on the flange of the control member so as to permit the adjusting disk to be turned counterclockwise to open the jaws. Corresponding parts in this embodiment bear the same numbers followed by suffix "a" as used in the embodiment of FIGS. 33–39. In accordance with the present embodiment, to raise the adjusting disk **904*a* cam ring 970 is provided between the lower surface of the dirt barrier collar 960*a* and the flange 934*a* of the control member 902*a*. The ring 970 carries a pair of cams 972 each having a ramp 974 that faces the lower surface of the dust barrier 960*a*. Notches 976 similar in size and shape to the cam 972 are provided in the lower surface of the dust barrier 960*a*, and when the cam 972*a* and notches 976 are aligned with one another, the adjusting disk 904*a* is permitted to move to its lowermost position under the influence of the wave spring 944 (see FIG. 33) so as to cause engagement of the gear segments 940*a* with the circular gear 930*a*. When the ring 970 is turned, however, the cam surface or ramp 974 bears against the mating surface of the notch 976 causing the adjusting disk 904*a* to rise to the position shown in FIG. 40 wherein the gear segments 940*a* and circular gear 930*a* are disengaged. In that position, the adjusting disk 904*a* is free to rotate counterclockwise so as to open the jaws 906**.

To facilitate rotation of the ring 970, a pair of posts 980 are connected to the ring 970 and lie within shallow recesses 982 provided in the periphery of the adjusting disk **904*a*. This arrangement is clearly shown in FIG. 42. The outer surface of each post 980 extends outside the recess 982 and therefore it is readily accessible to the tool user. When the operator wishes to open the jaws, he simply moves the post 980 in a counterclockwise direction as viewed in FIG. 42, which automatically causes the adjusting disk 904*a* to elevate to a position so that it may rotate and open the jaws. To relock the jaws after they have been adjusted on a work piece, the operator need simply move the posts 980 in a clockwise direction so as to cause the cams 972 to register with the slots 976, which allows the adjusting disk 904*a* to return to the position shown in FIG. 41**.

Additional Modification of the Jaw Locking System for the Embodiment of FIGS. 33–39.

The adjustable ratchet wrench head of this embodiment shown in FIGS. 44–48 is essentially identical to the head shown in the embodiment of FIGS. 33–39. Only the jaw locking assembly is changed. In this embodiment, the various parts of the head assembly bear the same numbers as the corresponding parts shown in FIGS. 33–39, followed by the suffix "b".

In accordance with this modification, the gear segments 940 in the adjusting disk 904 of the earlier embodiment are replaced by detents 990 mounted in recesses 992 in the adjusting disk **904*b*. In FIG. 45, one detent 990 is shown having teeth 994 in its lower surface that correspond to the gear segments 940 in the embodiment of FIGS. 33–39. The detent 990 is retained in recess 992 by bracket 996 which has a pair of upstanding ears 998 that wedge into small recesses 1000 disposed beyond the ends of the recess 992 containing the detent. As shown in FIG. 48, the ears 998 are bifurcated lending resilience to them and enabling them to serve as springs that frictionally engage the side walls of the recesses 1000 to hold the bracket 996 in place. The bracket 996 has an opening 1002 through which the teeth 994 of the detent extend so as to be in a position to engage the teeth of the circular gear 930*b* provided in the flange 934*b* of the control member 902*b*. The detent 990 is biased to a lowermost position by coil spring 1004 provided in a depression 1006 in the upper surface of the detent. This spring bears against the top of the slot 992 to yieldably bias the detent to the position shown in FIG. 45**.

The teeth 994 of each detent 990 perform precisely the same function as the gear segments 940 in the embodiment of FIG. 33, that is, when the teeth 994 engage the circular gear **930*b*, the adjusting disk 904*b* cannot be turned counterclockwise and therefore cannot open the jaws 906*b*. The jaws, however, may be closed because the ramp sides of the teeth will ride over one another as the spring 1004 is compressed enabling the detents to move in and out of their slots 992. Thus, the adjusting disk 904*b* may be turned clockwise so as to close the jaws without the disk 904*b* moving axially. The motion which occurs in that operation will be absorbed by the detents 990 and will not be reflected in corresponding motion of the adjusting disk 904*b*. However, when the jaws are to be opened, the adjusting disk 904 must be raised to the position shown in FIG. 45. Elevating the disk 904*b* will cause the bracket 996 to elevate the detents 990 so as to separate the teeth 994 from the circular gear 930*b*. With the adjusting disk 904*b*** elevated, it may then be turned counterclockwise so as to cause the jaws to move radially away from one another.

Preferred Embodiment of Power Adjustable Ratchet Wrench

The automatically powered adjustable ratchet wrench shown in FIGS. 49–59 comprises a head 1020 and handle 1022 integrally joined by a housing 1024. The housing 1024 is shown in outlined form in FIGS. 49 and 50. The housing 1024 provides the physical connection between the handle and head which enables the tool to be manually operated to turn the workpiece to be driven by the tool.

The head 1020 shown in detail in FIG. 51 includes as its major elements the housing 1024, control member 1026, adjusting disk 1028, jaws 1030 reversing pawl assembly 1032 and jaw locking assembly 1034. Several of these parts are described more fully below. The handle 22 contains as its major components a rechargeable battery 1036, On/Off assembly switch 1038, motor 1040, planetary gear reduction system 1042 and eccentric pin and gear shaft assembly 1044. The latter serves to connect the power handle to the head so as to enable the tool to be operated automatically by the motor.

The major parts of head 1020 are essentially the same as the head of the manually operated tool shown in FIGS. 33–39. The power handle 1022, with the exception of the eccentric pin and gear shaft assembly 1044 is essentially the same as the power handle shown in FIGS. 13 and 14. In this embodiment, however, the head is rotated stepwise by the power handle rather than with continuous rotation as in the earlier embodiment.

The control member 1026, adjusting disk 1028 and jaws 1030 in this embodiment cooperate in precisely the same manner as the manual tool shown in the embodiment of FIGS. 33 to 39. Thus, the control member 1026 has T-shaped radial slots (not shown) that received the T-shaped ribs (not shown) on the upper ends of the jaws so as to prevent rotation of the jaws relative to the control member (see FIG. 35). The cooperating T-shaped slots and ribs confine motion of the jaws relative to the control member to a radial path wherein the jaws move only toward and away from the head axis 1104. The adjusting disk 1028 has the same cam tracks and cam surfaces as present in the adjusting disk of the embodiment of FIGS. 33 to 39 so as to cause the jaws to move radially in the tracks of the control member when the control disk 1028 is rotated.

Figure 53:
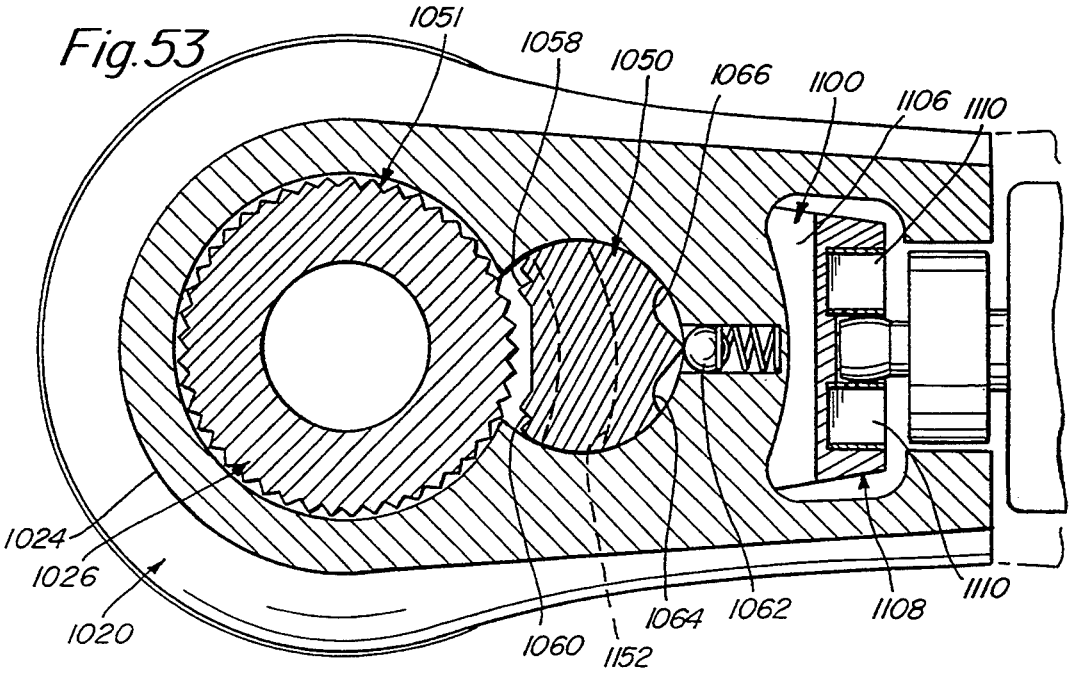

The reversing pawl assembly 1032 which controls the direction of drive is a duplication of the pawl assembly 908 in operatively connecting the control member 1026 to the handle. As shown in FIGS. 51 and 53, the pawl assembly 1032 includes reversing pawl 1050 and control lever 1052 that are coupled together by the non-circular mating post 1054 and recess 1056 in the pawl and lever, respectively. Pawl 1050 carries two sets of teeth 1058 and 1060 to selectively engage the circular gear 1051 formed on the outer surface of control member 1026. The alternate positions of the pawl are established by the ball detent 1062 and the recesses 1064 and 1066 in the pawl on the side opposite the teeth 1058 and 1060. This structure is functionally identical to the corresponding structure in the embodiment of FIGS. 33 to 39. With the pawl teeth 1060 engaging the circular gear on the control member 1026, the drive direction of the tool would be clockwise. That is, when the handle is turned manually in a clockwise direction, it will drive the control member 1026 in that direction, which will cause the jaws 1030 to turn in that direction. When the handle is turned counterclockwise, the teeth 1060 of the pawl will ride over the teeth of the circular gear 1051 on the periphery of the control member 1050. When the position of the pawl 1050 is reversed, counterclockwise rotation of the handle 1022 will serve as the driving direction for the tool when operated manually.

The reversing pawl assembly 1032 is mounted in a well in the housing 1024 and is retained in the well by the retaining ring 1068. The axis of rotation of the reversing pawl assembly 1032 intersects the longitudinal center line of the tool as shown in FIG. 53.

The assembly of components within the handle 1022 are well-known in the art and the details thereof are not part of this invention. Rather, the manner in which they cooperate to drive the head 1020 of the tool is applicants' invention. Briefly, the rechargeable battery 1036 disposed in handle 1022 is connected through the button actuated switch assembly 1038 to motor 1040. The motor is turned on and off by the control button 1082. Motor 1040 in turn is directly connected to the planetary gear reduction system 1042. The output shaft 1094 of the gear reduction system rotates an eccentric pin 1090 of the gear and shaft assembly 1044.

As is shown in FIGS. 51, 51A, and 51B, the eccentric pin and gear shaft assembly 1044 includes the eccentric pin 1090 extending axially in the direction of the head 1024 of the tool on the periphery of disk 1092 mounted on the output shaft 1094 of the gear reduction system. The eccentric pin 1090 moves in a circular path and drives the control member 1026 through the mechanical assembly described below.

Figure 55:
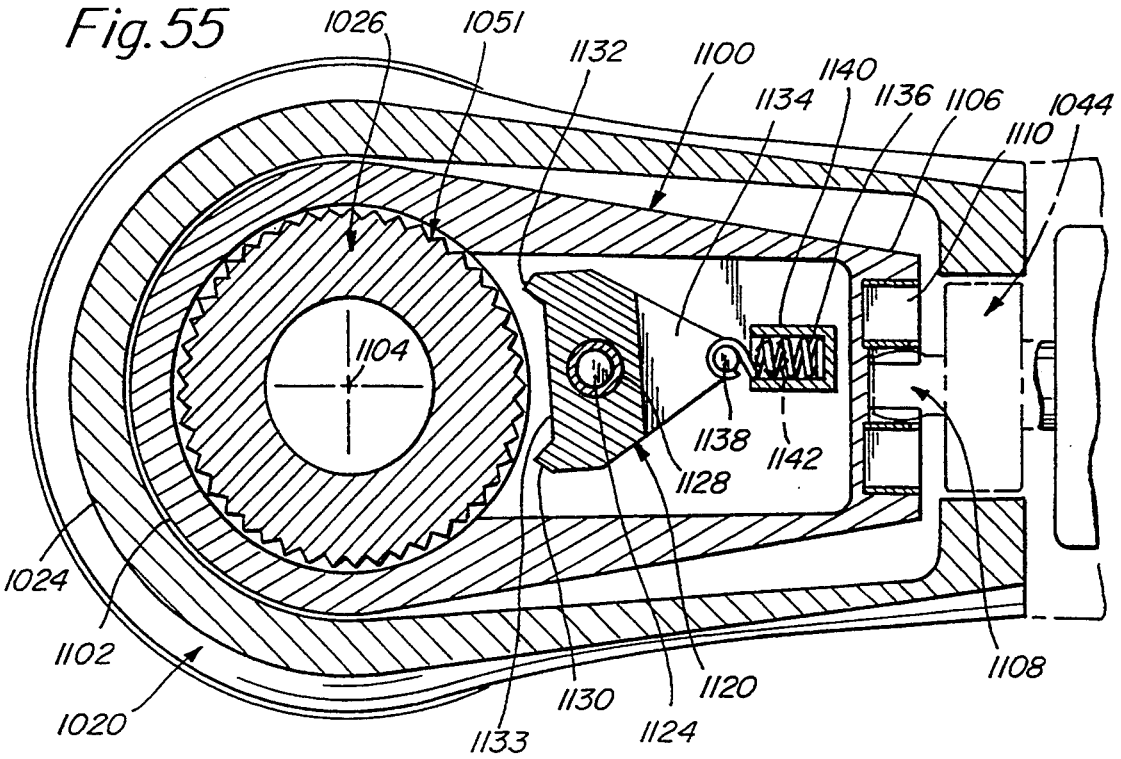

In FIG. 55, a cradle 1100 is shown to extend from the pin and gear shaft assembly 1044 at its right end into the head 1020 of the tool with an arcuate section 1102 surrounding the control member 1026. The portion 1102 which surrounds the control member 1026 does not engage the circular gear 1051 carried on control member 1026 but rather freely pivots about the axis 1104 of the head relative to that member.

The handle end 1106 of cradle 1100 carries a slide 1108 (see FIGS. 51A and 51B) within which the pin 1090 moves to cause the cradle to rock back and forth about the axis 1104 of the head. Circular motion of the pin causes the slide to oscillate back and forth as suggested by the broken lines and arrows in FIG. 51B. A pair of force release springs 1110 are disposed in the slide 1108 on each side of pin 1090 to prevent the pin 1090 from binding on the margins of the slide should the tool be shut off with the pin in a neutral position in the slide. The springs provide some play between the pin 1090 and the slide side walls 1091 so as to enable the pin to move from a neutral position and thereafter impart motion to the slide and thereby to the cradle.

Motion of the cradle is converted to rotational motion of the control member 1026 by virtue of the operative connection of the two by means of the driving pawl 1120. The driving pawl and its relation to the cradle 1100 is clearly shown in FIGS. 51 and 55. In FIG. 51, the cradle 1100 is shown to include a tray portion 1122 on the handle side of the control member 1026. A post 1124 extends upwardly from the bottom wall 1126 of the tray portion, and the post carries a bushing 1128 which in turn supports the driving pawl 1120 for pivotal motion thereon. Driving pawl 1120 has separate teeth 1130 and 1132 at each end of the pawl side 1133 facing the control member 1026. The teeth 1130 and 1132 are similar to the teeth 1058 and 1060 on reversing pawl 1050, and the teeth 1130 and 1132 are positioned so as to selectively engage the teeth on the circular gear 1051 on the periphery of the control member 1026. In FIG. 55, the driving pawl 1120 is shown in a neutral position where neither of the gears 1130 and 1132 engages the control member but in operation, one or the other of the teeth engages the circular gear 1051.

The driving pawl 1120 is generally triangular in shape, and as stated, it is pivotally supported on the post 1124 fixed to the bottom wall 1126 of the cradle. The corner 1134 of the cradle is connected to a coil spring 1136 by means of pin 1138, and the spring in turn is captured within spring housing 1140 that is pivotally supported by means of its post 1142 in the bottom wall 1126 of the cradle. The spring housing 1140 is also supported for pivotal motion by an upstanding post 1144 disposed in a recess 1146 on the lower surface of the cover 1148 of the tray portion of the cradle 1100.

Figure 54:
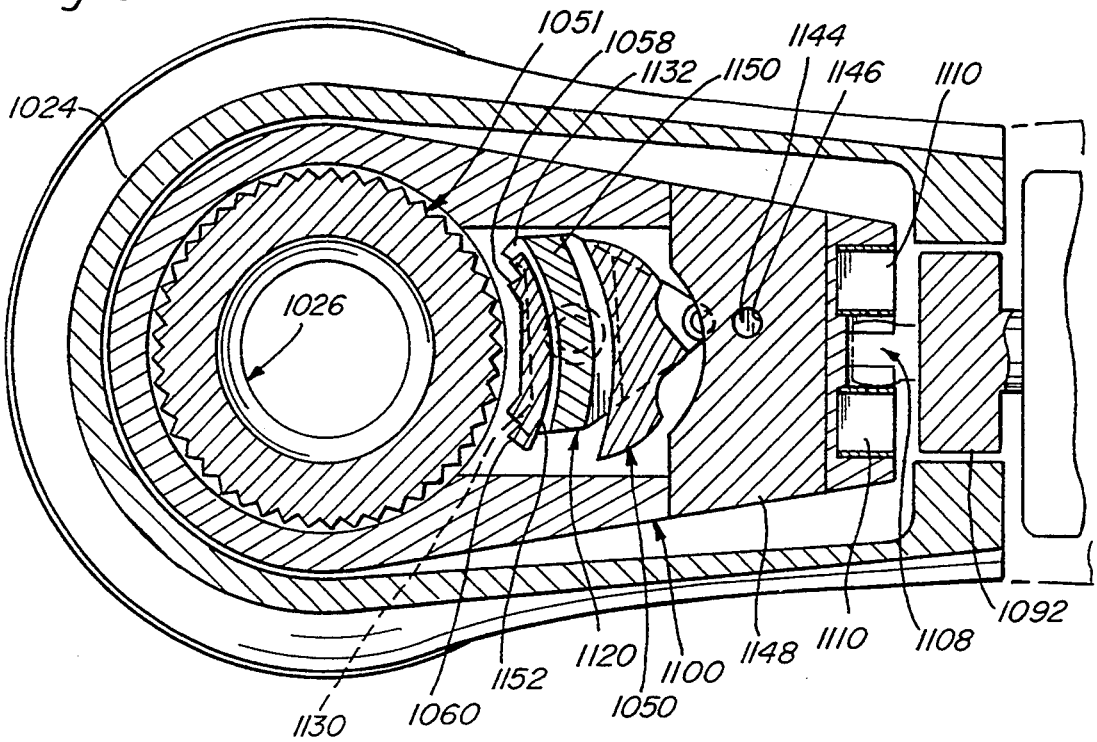

As shown in FIGS. 51 and 54, the driving pawl 1120 carries a curved rib 1150 on its upper surface that extends into a curved channel 1152 in the bottom surface of reversing pawl 1050. The curved rib 1150 and its cooperating channel 1152 enables the reversing pawl 1050 to control the position of the driving pawl 1120. That is, when the reversing pawl 1050 is pivoted by means of its control lever 1052 so as to cause its teeth 1058 to engage the circular gear 1051 on the control member 1026, the tooth 1132 on the driving pawl 1120 will also engage the circular gear on the control member. When the position of the reversing pawl is changed so that its teeth 1060 engage the gear of control member 1026, the position of the driving pawl is similarly changed so as to cause its tooth 1130 to engage the circular gear 1027 of the control member.

Figure 56:
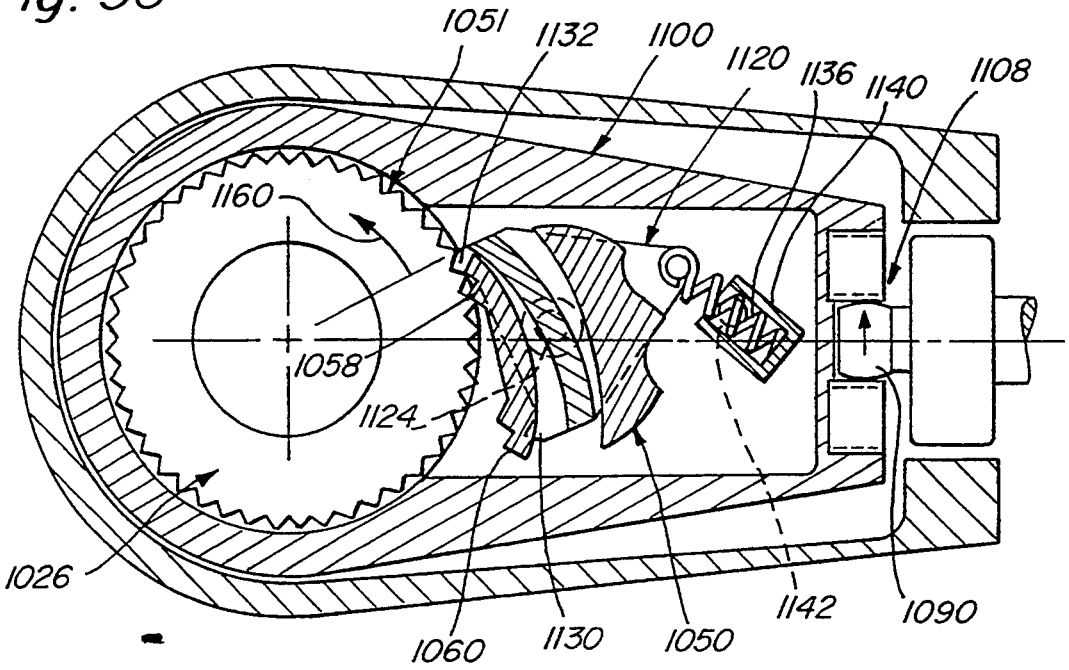
Figure 57:
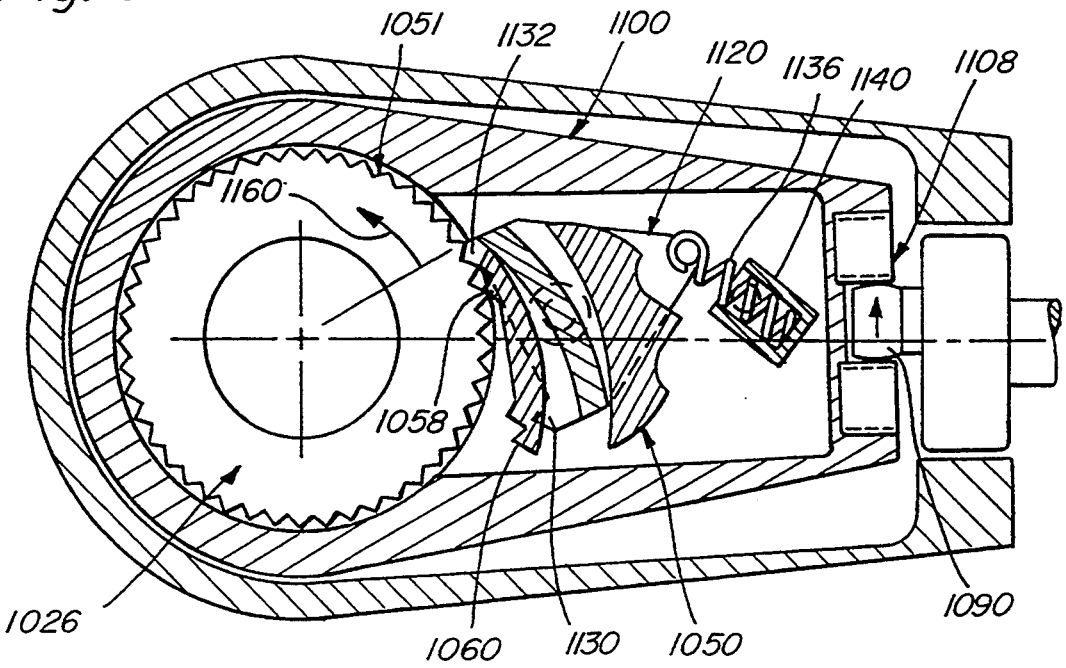
Figure 58:
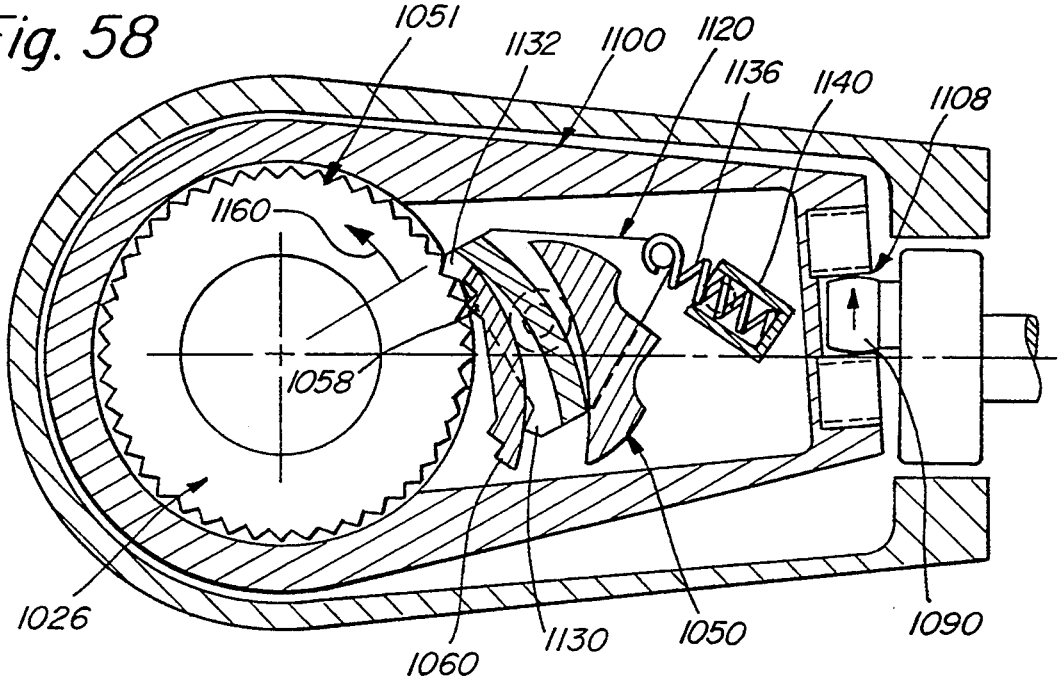

In FIGS. 56 to 59, the manner in which the driving pawl 1120 and reversing pawl 1050 cooperate with one another in both the manual and automatic or power phases of the operation is suggested. In FIG. 56, the eccentric pin 1090 is shown to be vertically aligned with the longitudinal axis of the tool in what may be termed a neutral position and the teeth 1058 of the reversing pawl 1050 and the tooth 132 of the drive pawl 1120 are positioned to operatively engage the control member 1026 and more particularly the circular gear 1051 on its periphery. Positioning the reversing pawl 1050 in the position shown in FIG. 56 automatically causes the driving pawl 1120 to assume the position illustrated also. As the eccentric pin 1090 moves away from the longitudinal center line of the tool as shown in sequence in FIGS. 57, 58, and 59, through its engagement with the slide 1108 in the cradle, the cradle pivots counterclockwise about head axis 1104 and carries the driving pawl 1120 with it. By virtue of the engagement of tooth 1132 of the driving pawl with the circular gear 1051 on the control member 1026, the control member turns counterclockwise as suggested by arrow 1160 and turns the jaws of the tool with it. As the cradle 1100 and driving pawl 1120 cause the control member 1026 to move in that direction, the reversing pawl 1050 and more particularly its teeth 1058 skip over the teeth initially engaged and move to the next adjacent teeth without interfering with the rotation of the control member 1026.

Figure 59:
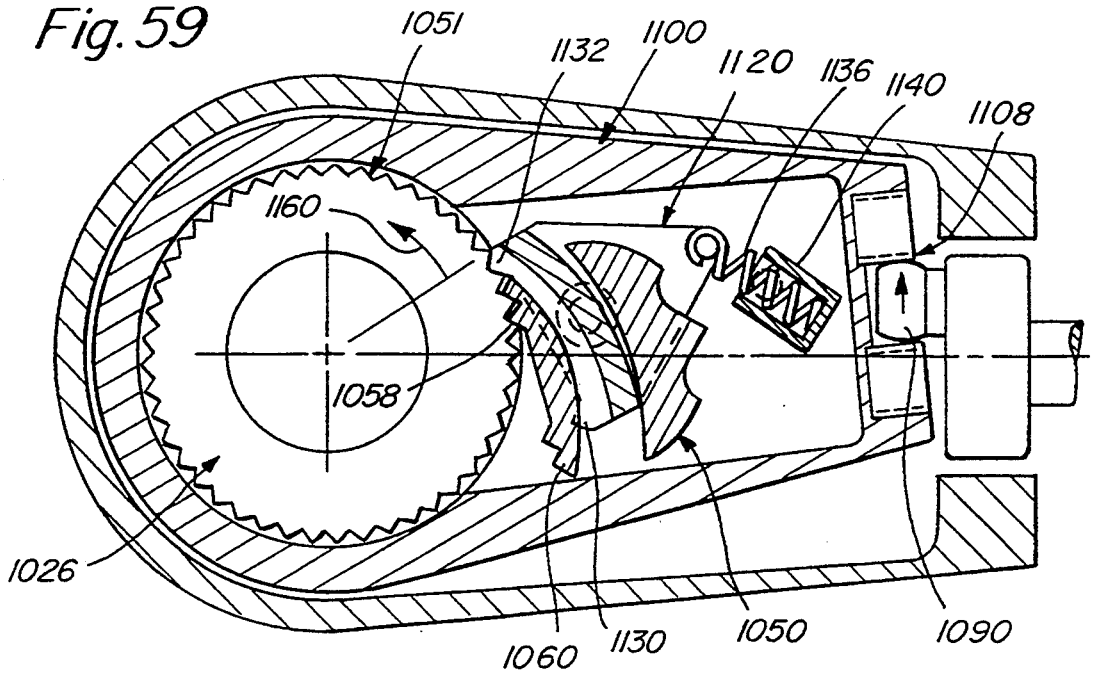

In FIG. 59, the eccentric pin 1090 is shown to have moved through 90° causing maximum pivoting action of the cradle in a counterclockwise direction about the head axis 1104. In that figure it will be noted that the teeth 1058 of the reversing pawl have moved to the next teeth on the circular gear on control member 1026. During the next 180° of rotation of the eccentric pin 1090, the cradle will move from the position shown in FIG. 59 to an opposite position, that is, the other extreme position of cradle 1100. As that occurs, the tooth 132 will ride over the engaged tooth of the circular gear and engage the next tooth of the circular gear. Simultaneously, the reversing pawl 1050 will prevent the control member 1026 from being dragged by the drive pawl in that direction. As the eccentric pin 1090 moves the last 90° of its course to return to the position shown in FIG. 56, the driving pawl 1120 with its tooth 1132 engaging the circular gear 1051 will once again cause the rotation of the control member in the direction of arrow 1160.

To reverse direction of rotation of the control member 1026, the operator need only reverse the position of the reversing pawl assembly 1032 so as to cause the teeth 1060 to engage the circular gear 1051. That in turn will cause the tooth 1130 of the driving pawl 1120 also to engage the circular gear, and the oscillating motion of the cradle in response to rotation of the eccentric pin 1090 will cause the control member to rotate in a clockwise direction.

From the foregoing description, it will be appreciated that spring 1136 allows the driving pawl 1120 to ride over the teeth on the circular gear of the control member during that portion of the cycle in which the driving pawl steps back over the teeth to engage the next tooth of the circular gear 1051 so as to enable it to again advance it under the influence of the motor. When the driving pawl 1120 is reversed by means of the change in position of reversing pawl 1050, the spring housing 1140 pivots on its posts 1142 and 1144 to the position opposite that depicted in FIG. 56.

As stated above, the reversing pawl 1050 is pivotally supported along the longitudinal center line of the tool. However, the driving pawl 1120 is shown positioned offset from longitudinal center line of the tool by approximately 4°. In the embodiment shown, there are 45 teeth on the circular gear carried by the control member 1026, and therefore each tooth represents 8° of rotational motion of the control member when it is advanced by the driving pawl 1120. Because the driving pawl is circumferentially displaced 4° from the reversing pawl 1050, the pivotal motion of the two pawls as they slide over the teeth from one cycle to the next will be out of phase with one another.

The tool shown in FIGS. 49 to 59 may be powered either manually or electrically. However, the electrical or automatic drive phase of the tool is principally used to rapidly run the workpiece such as a bolt from one end of a screw to a point where it encounters major resistance to rotation, or alternatively, to unscrew the bolt from the screw after initially overcoming the major resistance to rotation. The tool typically is used as follows: with the motor turned off, the user sets the reversing pawl and then tightens the jaws on the workpiece by rotating the adjusting disk 1028. When this is done, the operator depresses the power button 1082 which causes the power handle to turn the eccentric pin 1090 and through cradle 1100 and pawl 1120 rotates the control member 1026 so as to cause the workpiece engaged by the jaws to rotate until substantial resistance is encountered. When that occurs, the user releases the power button 1082 and continues rotation of the control member 1026 by rotating the handle about the head axis. In this fashion, the workpiece may be tightened to the degree desired. Because, this power driven tool includes the jaw locking system 1034 shown in the embodiment of FIGS. 33 to 39, the jaws will not open in response to the reactive force applied to them by the workpiece as torque is applied by the tool to it.

While in the foregoing description, the power handle described is driven by a rechargeable battery, it should be understand that in addition to the rechargeable battery the handle housing may also contain a low voltage DC power supply and charging circuit along with a plug receptacle for receiving the plug of an electrical cord. With such an arrangement, the tool may be used either as a cordless power tool when the rechargeable battery is fully charged or it may be driven by primary electric power through the electrical cord. Similarly, the power handle may be pneumatically driven by conventional power handle arrangements that are well-known. In either of these modifications, the eccentric pin is driven by the power supply and connected to the head through the rocking cradle in the manner shown.

Having described and illustrated this invention in detail, those skilled in the art upon reading the description will recognize that numerous modifications may be made in the several embodiments without departing from the spirit of this invention. Therefore, it is not intended that the scope of the invention be limited to the specific embodiments illustrated and described. Rather, its scope is to be determined by the appended claims and their equivalents.

What we claim is:

1. An adjustable wrench comprising:

a housing having an axis, a plurality of jaws carried by the housing and extending beyond the housing parallel to the axis, said jaws having inner and outer surfaces, an adjusting mechanism surrounding the jaws and having axially facing cams engaging the outer surfaces of the jaws for moving the jaws toward the axis when the adjusting means is rotated, a control mechanism provided in the housing for preventing rotation of the jaws with respect to the housing and slots oriented radially with respect to the axis, said jaws having an engaging means engaging said slots, and a locking mechanism provided on the adjusting mechanism for resisting rotation of the adjusting mechanism in the housing, said locking mechanism having a plunger movable in said housing and a mechanism which translates said movement of plunger to engage and disengage said locking mechanism, and said adjusting mechanism includes an adjusting disk which is axially movable, in said housing.

2. An adjustable wrench as recited in claim 1 wherein the control mechanism has a control member and the housing and control member have openings therethrough coaxial with the axis of the housing for enabling a member onto which the workpiece is to be turned to extend through the head.

3. An adjustable wrench as recited in claim 1, wherein the said plunger is movable in a direction parallel to the housing axis.

4. An adjustable racket wrench as recited in claim 1, wherein said control mechanism supports said adjusting mechanism, and wherein said locking mechanism further comprises a biasing mechanism disposed between an upper surface of said adjusting mechanism and a lower surface of said housing to bias said adjusting mechanism downward so that the bottom surface of said adjusting mechanism is biased against the upper surface of an annular flange of said control mechanism.

5. An adjustable wrench as recited claim 1 further comprising an adjusting disk surrounding at least a portion of the control member and having axially inwardly directed cams engaging the jaws for driving the jaws radially inwardly in response to rotation of the disk in one rotational direction with respect to the control member, and wherein the adjusting disk is movable axially with respect to the control member on the housing.

6. An adjustable wrench as recited in claim 5 wherein the axial movement of the adjusting disk controls the condition of the locking mechanism.

7. An adjustable wrench as defined in claim 6 wherein the adjusting disk is biased axially in one direction to activate the locking mechanism, and motion of the disk in the opposite axial direction against the bias releases the locking mechanism.

8. An adjustable wrench as defined in claim 5 and further comprising a camming mechanism which is operatively connected to the adjusting disk for moving the disk axially when the camming mechanism is moved circumferentially with respect to the axis.

9. An adjustable wrench as defined in claim 8 wherein said camming mechanism includes a rotatably mounted ring disposed between the control member and the disk.

10. An adjustable wrench as defined in claim 9 wherein, the control member has a flange which radially overlaps an end of the adjusting disk near the jaws, said flange having teeth, the teeth on the disk are movable axially with respect to the disk toward and away from the teeth on the flange.

11. An adjustable wrench as defined in claim 5 wherein, the control member has a flange which radially overlaps an end of the adjusting disk near the jaws, and wherein the flange and said end of the disk have opposed faces and the locking mechanism is disposed between the flange and said end of the disk on said faces.

12. An adjustable wrench comprising, a housing having an axis, a plurality of jaws carried by the housing and extending beyond the housing parallel to the axis, said jaws having inner and outer surfaces, adjusting means surrounding the jaws and having axially faced cams engaging the outer surfaces of the jaws for moving the jaws toward the axis when the adjusting means is rotated, control means provided in the housing for preventing rotation of the jaws with respect to the housing and slots oriented radially with respect to the axis, said jaws having means engaging said slots, locking means provided on the adjusting means for resisting rotation of the adjusting means in the housing, and wherein the adjusting means includes an adjusting disk which is movable axially with respect to the control member on the housing.

13. An adjustable wrench as defined in claim 12 wherein the axial movement of the adjusting disk controls the condition of the locking means.

14. An adjustable wrench as defined in claim 13 wherein the adjusting disk is biased axially in one direction to activate the locking means, and motion of the disk in the opposite axial direction against the bias releases the locking means.

15. An adjustable wrench comprising, a housing having an axis, a plurality of jaws carried by the housing and extending beyond the housing parallel to the axis, said jaws having inner and outer surfaces, adjusting means surrounding the jaws and having axially faced cams engaging the outer surfaces of the jaws for moving the jaws toward the axis when the adjusting means is rotated, control means having a control disk provided in the housing for preventing rotation of the jaws with respect to the housing and slots oriented radially with respect to the axis, said jaws having means for engaging said slots, and wherein the control disk has a tubular portion extending the entire axial distance through the housing.

16. An adjustable wrench as recited in claim 15 wherein the adjusting means includes an adjusting disk which is axially movable with respect to the housing.

17. An adjustable wrench as recited in claim 16 wherein the axial movement of the adjusting disk controls the condition of the locking means.

18. An adjustable wrench as recited in claim 17 wherein, the adjusting disk is biased axially in one direction to activate the locking means, and motion of the disk in the opposite axial direction against the bias releases the locking means.

19. An adjustable wrench as recited in claim 15 wherein, the housing and control member have openings therethrough coaxial with the axis of the housing for enabling a member onto which the workpiece is to be turned to extend through the head.

20. An adjustable wrench as recited in claim 15 wherein, the control member has a flange which radially overlaps an end of the adjusting disk near the jaw, and wherein the flange and said end of the disk have opposed faces and the locking means is disposed between the flange and said end of the disk on said faces.

21. An adjustable wrench as defined in claim 20 wherein, the locking means includes teeth on the opposed faces that engage one another to activate the locking means and separate from one another to release the locking means.

22. An adjustable wrench as recited in claim 21 wherein, the disk is moved axially with respect to the control member to separate the teeth so as to release the locking means.

23. An adjustable wrench as recited in claim 22 wherein, a dust cover encloses the teeth on the faces.

24. An adjustable wrench as recited in claim 15 wherein, the control member is biased to move away from the adjusting disk.

25. An adjustable wrench head for turning a workpiece about an axis comprising:

a housing, a control member mounted in the housing and having a plurality of radially extending slots, a plurality of jaws, one for each slot, mounted on the control member and extending beyond the housing and movable toward and away from the axis, the jaws having a gripping surface for engaging the workpiece and a cam surface, an adjusting member surrounding the jaws and having cam surfaces which engage the cam surface of each jaw such that when the adjusting member is rotated the engaging cam surfaces cause the jaws to close, and a locking mechanism between the control member and the adjusting member allowing relative rotational motion between the control member and the adjusting member in one direction and preventing relative rotational motion in the other direction.

26. An adjustable wrench head as recited in claim 25 wherein coaxial openings are provided in the housing, the adjusting member and the control member for allowing a shaft around which the workpiece is turned to extend through the housing.

27. An adjustable wrench head as recited in claim 26 wherein the locking mechanism is disabled by moving the control member and the adjusting member axially with respect to one another thereby permitting rotation of the adjusting member relative to the control number so as to open the jaws.

28. An adjustable wrench head as recited in claim 27 further comprising outwardly facing cam surfaces on the adjusting member, inwardly facing cam surfaces on the jaws whereby the outwardly facing cam surfaces on the adjusting member engage the inwardly facing cam surfaces on the jaws for moving the jaws away from the axis when the adjusting member is rotated around the control member so as to open the jaws.

29. An adjustable wrench head as recited in claim 25 further comprising: a flange on the control member, and the locking mechanism includes teeth disposed on the flange and teeth disposed on the adjusting ring.

30. An adjustable wrench head as recited in claim 26 wherein the gripping surface of the jaws is V-shaped and two jaws are provided on the wrench head.

31. An adjustable wrench head as recited in claim 26 wherein three jaws are provided on the wrench head.

32. An adjustable wrench head as recited in claim 26 wherein the locking mechanism includes teeth disposed on the control member and teeth disposed on the adjusting member, wherein the teeth on the adjusting member operatively connect with the teeth on the control member to limit the rotational motion between the control member and the adjusting member when the teeth are engaged.

33. An adjustable wrench head for turning a workpiece comprising:

a housing having a chamber, an axis located in the chamber, a control member mounted in the chamber and having a lower end, a support surface on the lower end of the control member extending in a direction normal to the axis of the control member, the lower end of the control member having radially extending slots, a plurality of jaws, one disposed in each slot, gripping surfaces disposed on the jaws and parallel to the axis, the jaws having inner and outer ends and an intermediate portion, a cam surface disposed on each intermediate portion, an annular adjusting-disk surrounding the jaws, the adjusting disk including cam surfaces engaging the intermediate portions of the jaws, wherein the cam surfaces on the adjusting disk cause the jaws to move radially inward with respect to the axis when the adjusting disk is rotated in one direction with respect to the control member, and a locking mechanism included at an interface between the adjusting disk and control member that prevents the rotation of the adjusting disk in the opposite direction with respect to the control member.

34. An adjustable wrench as recited in claim 33 wherein coaxial openings are provided in the housing, control member, and the adjusting disk for enabling a shaft onto which a workpiece is placed to extend through the coaxial openings.

35. An adjustable wrench head as defined in claim 34 wherein the adjusting disk is axially movable with respect to the control member, and the locking mechanism is disengaged when the adjusting member is axially moved with respect to the control member.

36. An adjustable wrench head for turning a work piece about an axis comprising:

a housing a control member rotatably mounted in the housing, a plurality of radially extending slots at the lower end of the control member, and a locking interface disposed on the surface of the control member, a plurality of jaws, one for each slot, mounted on the control member and extending beyond the housing, each jaw having a gripping surface facing toward the axis, a first cam surface disposed on each jaw facing outward with respect to the axis and a second cam surface facing inward with respect to the axis, an adjusting ring surrounding the jaws and having radially inward facing cam surfaces engaging the first cam surfaces on the jaws for moving the jaws toward the axis when the adjusting member is rotated in one direction, and radially outward facing cam surfaces engaging the second cam surface on the jaw for moving the jaws away from the axis when the jaws are in the opposite direction, a locking interface disposed on the surface of the adjusting ring, wherein the locking interface on the control mechanism operatively connects to the locking interface on the adjusting member whereby the the jaws are prevented from moving radially outward with respect to the axis in response to a reactive force applied to the jaws by the workpiece engaged by the jaws.

37. An adjustable wrench head as defined in claim 36 wherein each of the housing, control member and adjusting member has coaxial openings for enabling a shaft onto which a workpiece engaged by the jaws is to be turned, to extend through the head.

38. An adjustable wrench for turning a workpiece comprising:

a housing having an axis, a plurality of jaws extending beneath the housing and movable towards and away from the axis, said jaws having workpiece engaging surfaces and outwardly facing cam surfaces, a guide member mounted in the housing and engaging the jaws to restrict movement of the jaws to radial motion with respect to the axis, an adjusting member surrounding the jaws and having inwardly facing cam surfaces engaging the outwardly facing cam surfaces of the jaws for moving the jaws towards the axis when the adjusting member is rotated, and a locking mechanism operatively associated with the guide member and adjusting member whereby the jaws are prevented from radially outward movement.

39. The adjustable wrench head of claim 38 wherein the adjusting member on and the control member are adapted for axial motion therebetween, the latching mechanism being disengaged by such axial motion between the adjusting member and control member, and inwardly facing cam surfaces on the jaw, and outwardly facing cam surfaces on the adjusting member, engage to move the jaws away from the axis when the adjusting ring is rotated.

40. The adjustable wrench of claim 38 further comprising a support surface extending in the normal direction from the lower part of the control member.

* * * * *